US007565065B2

(12) United States Patent
Kato

(10) Patent No.: US 7,565,065 B2
(45) Date of Patent: Jul. 21, 2009

(54) FLUID HEATER AND FLUID HEATING APPARATUS

(75) Inventor: Yoshihiko Kato, Osaka (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 621 days.

(21) Appl. No.: 11/259,379

(22) Filed: Oct. 26, 2005

(65) Prior Publication Data

US 2006/0086492 A1 Apr. 27, 2006

(30) Foreign Application Priority Data

Oct. 26, 2004 (JP) ..... 2004-311267
Jan. 25, 2005 (JP) ..... 2005-016378

(51) Int. Cl.
*H05B 3/60* (2006.01)

(52) U.S. Cl. ..... 392/311; 392/465; 392/466

(58) Field of Classification Search ..... None
See application file for complete search history.

(56) References Cited

U.S. PATENT DOCUMENTS 3,404,905 A * 10/1968 Albrecht ..... 285/249
3,428,339 A * 2/1969 Decker et al. ..... 277/627
3,679,239 A * 7/1972 Schmitt ..... 285/148.22
3,784,236 A * 1/1974 Slocum ..... 285/45
4,120,521 A * 10/1978 Parmann ..... 285/113
4,427,219 A * 1/1984 Madej ..... 285/249
4,934,745 A * 6/1990 Healy ..... 285/255
5,054,108 A 10/1991 Gustin et al.
5,371,830 A 12/1994 Wachenheim et al.
5,408,578 A * 4/1995 Bolivar ..... 392/490
5,740,315 A * 4/1998 Onishi et al. ..... 392/489
5,872,890 A * 2/1999 LaCombe ..... 392/487
6,205,292 B1 3/2001 Pokorny et al.

FOREIGN PATENT DOCUMENTS

EP 1 041 330 10/2000
EP 1 262 702 12/2002
GB 2 047 510 11/1980
JP 10-160362 6/1998

* cited by examiner

*Primary Examiner*—Thor S Campbell
(74) *Attorney, Agent, or Firm*—William L. Androlia; H. Henry Koda

(57) ABSTRACT

A fluid heater is configured by passing a cartridge heater H covered by a fluororesin, through a casing 1. The casing 1 has: a fluororesin-made case body 4 which incorporates the cartridge heater H; fluororesin-made lid bodies 5 which are attached to both ends of the case body involving sealing portions S, respectively; fluid supplying/discharging portions 31 which are formed in the lid bodies 5, and through which a fluid is introduced and discharged; and fluororesin-made union nuts 6 which are externally fitted to both ends of the case body 4 and screwed to the lid bodies 5. Sealing portions S formed between the case body 4 and the lid bodies 5 are closely contacted by fastening the union nuts 6 to the lid bodies 5. A lead-out portion 34 for the cartridge heater H is formed in at least one of the paired lid bodies 5.

20 Claims, 21 Drawing Sheets

FLUID HEATER AND FLUID HEATING APPARATUS

BACKGROUND OF THE INVENTION

1. Field of the Invention

The present invention relates to a fluid heater and a fluid heating apparatus for a high purity liquid such as ultrapure water, various chemical liquids, and the like, and more particularly to a fluid heater which is suitably useful in a pipe or the like for a fluid that is handled in, for example, an apparatus for producing a semiconductor device, liquid crystal display devices, or chemicals, and a production line for foods, and a fluid heating apparatus which is configured by combining a plurality of such fluid heaters.

2. Explanation of Related Art

Some of fluid heaters of this kind are configured so that a heater is disposed in a casing with being passed through the casing, and a fluid passing through the interior of the casing is heatable by the heater. For example, the outer face of a metal-made rod-like heater is covered by a metal material with reduced metal elution such as special stainless steel, and the heater is passed through a cylindrical casing which is made of a clean synthetic resin material, and both ends of which are closed. A fluid is caused to flow through the casing with using a fluid inlet and a fluid outlet which are disposed in the end portions of the casing, respectively. Therefore, the fluid passing through the interior of the casing or staying therein can be heated by the rod-like heater.

The casing constituting the above-mentioned fluid heater is strictly requested not to leak the fluid. Namely, in addition to prevention of leakage from the inlet and the outlet for the fluid passing through the interior, leakage prevention is applied also to the passing position of the rod-like heater in the casing, and therefore the number of places where the countermeasure for preventing leakage is to be taken is large. In a fluid heater in which a rod-like heater is penetratingly disposed, it is an issue to form a leakage-free casing in an excellent productivity state. It is contemplated that the configuration disclosed in Patent Reference 1 is employed in the casing.

Japanese Patent Application Laying-Open No. 10-160362 discloses a heat exchanger in which heat exchange tubes are passed into a cylindrical casing. The structure of the heat exchanger will be described. As shown in FIGS. 21 and 22, in order to ensure the casing 81 through which the heat exchange tubes 80 pass to have a sufficient sealing property that can withstand an internal pressure of a certain degree, plural metal fastening members 83 such as tie rods or through-bolts are placed in parallel on the outer periphery of a shell 82 constituting the body of the casing 81 so as elongate along the longitudinal direction. Both end portions of the metal fastening members 83 are passed through lid members 84 placed in both end portions of the shell 82. Nuts 85 are fastened to external thread portions in both ends of the metal fastening members 83 protruding from the lid members 84, respectively, whereby hermetical seal is provided between butting faces of the end portions of the shell 82 and the lid members 84. As a result, the casing 81 is hermetically configured. Furthermore, O-rings 86 serving as sealing members are interposed between the butting faces of the end portions of the shell 82 and the lid members 84.

In the structure in which the end portions of the shell 82 and the lid members 84 are sealed by fastening the metal fastening members 83 such as tie rods or through-bolts with the nuts 85, however, the number of components for sealing is so large that the cost is increased and the casing structure is enlarged. When the heat exchanger is installed in a place where it is exposed to a sulfuric acid ambient or the like, the metal fastening members 83 easily corrode, and metal contamination inevitably occurs. Recently, therefore, restriction of use of such a heat exchanger is highly requested particularly in the field of semiconductor devices.

In order to avoid loosening of the metal fastening members 83, the metal fastening members 83 must be periodically refastened. Usually, the metal fastening members 83 are plural or at least four, and hence the degrees of refastening of the metal fastening members 83 are easily dispersed. This dispersion produces the possibility that the lid members 84 and the shell 82 are deformed. When the lid members 84 and the shell 82 are deformed, twisting or distortion is produced between the end portions of the shell 82 and the lid members 84, and hence there arises a problem in that local stress concentration occurs to promote development of creep. The center axes of metal tie rods of the metal fastening members 83 fail to coincide with those of metal tie rod sheaths, thereby causing problems in that both the members rub against each other to increase the sliding resistance, and that generation of abrasion dust containing metal powder is caused. When the shell 82 and the lid members 84 are deformed, moreover, these members must be replaced with new ones. Usually, the members are machined products, and hence relatively expensive. In the structure, therefore, recycling in which the casing structure is replaced with new one and the internal devices (heat exchange tubes 80) remain to be used is hardly performed.

In the case where the connecting structure in which the O-rings 86 serving as sealing members are interposed between the butting faces of the end portions of the shell 82 and the lid members 84 is applied to a fluid heater, the use of the O-rings 86 causes the corrosion resistance and the range of the service temperature to be limited. For example, a high-temperature chemical liquid cannot be passed through the spaces surrounding the O-rings 86. Furthermore, contamination due to dust generation of the O-rings 86 may be problematic. Recently, therefore, restriction of use of a component such as the O-rings 86 is highly requested in the field of semiconductor devices.

In the case where a fluid heater of this kind is to be used in heating a chemical liquid or the like, a fluororesin having excellent corrosion resistance, such as PTFE or PFA is often used in the components such as the shell 82 and the lid members 84. However, a fluororesin has high lubricity, and hence creep due to vibration or heat of a pipe occurs in the connecting portions between the shell 82 and the lid members 84. As a result, there arises a problem in that the metal fastening members 83 such as tie rods or through-bolts are loosened and fluid leakage from the connecting portions in the ends of the shell 82 is caused.

Alternatively, thread sealing or welding may be employed as the casing connecting structure between the shell 82 and the lid members 84. However, these measures are not highly effective. In a sealing structure which is based simply on threads, a high sealing property cannot be obtained, the pressure resistance is not sufficiently high, and leakage due to creep easily occurs. Usually, welding requires a skilled technique, and cannot be conducted by an easy work. Therefore, welding has problems in that the production efficiency is low, that the on-site workability is poor, and that it is difficult to conduct maintenance and inspection on the site. Furthermore, welding has aspects in which, even when specification is changed, replacement of internal components such as a heater is substantially impossible, and the components are not suitable to recycle or reuse.

SUMMARY OF THE INVENTION

The invention has been conducted in order to solve the problems. It is an object of the invention to provide a fluid heater in which, without using metal fastening members such as tie rods or through-bolts, and O-rings, the number of components and the cost can be reduced, and which has a compact casing structure of high pressure resistance, and a highly reliable sealing structure. It is another object of the invention to provide a fluid heating apparatus which uses a plurality of such fluid heaters, whereby a large amount of fluid or the like can be temperature raised or heated in a pipe line.

According to the invention, the fluid heater has: a casing 1 configured by a case body 4 formed by a tube member, and lid portions f which are detachably attached to respective end portions of the case body 4 to close the end portions; and a heater H which is passed through at least one of the lid portions f to be placed in an interior of the case body 4, and fluid supplying/discharging portions 30, 31 for an inner space of the case body 4 are formed in at least two places of the lid portions f, respectively.

According to the invention, the casing into which the heater is passed is configured by the tube member and the detachable lid members which are attached to the ends of the tube member, respectively. Unlike the conventional art, without using metal fastening members such as tie rods or through-bolts, and O-rings, a fluid heater in which the number of components and the cost can be reduced, and which has a compact casing structure of high pressure resistance, and a highly reliable sealing structure can be obtained. Moreover, the lid portions are detachably attached to the respective ends, and the case body serving as a portion where a fluid flows or stays is configured by the tube member. Therefore, simple means for simply changing the length of the tube member can easily cope with a capacity change. When a casing of a capacity of 400 cc is to be changed to that of 600 cc, it is requested only to replace the case body with another case body having a length of about 3/2 times. Therefore, it is possible to provide a convenient fluid heater which can flexibly cope with a capacitor change or a heating temperature change. As the heater, useful are a long heater such as a rod-like or spiral heater which is covered by a fluororesin material, a lamp heater which is covered by a fluororesin material, and a quartz heater.

The invention is characterized in that, in the fluid heater, the tube member is made of a flexible synthetic resin, each of the lid portions f is configured by: a lid body 5 having a receiving port 8 which receives a corresponding one of the end portions of the case body 4, and at least one sealing face 10 which is disposed in the receiving port 8; a union nut 6 which is externally screwable with a receiving port-side end portion of the lid body 5 in a state where the union nut is externally fitted to the end portion of the case body 4; and at least one sealing portion S which is formed by screwingly advancing the union nut 6 to the lid body 5 to press the case body 4 from an outside, and by closely contacting the end portion of the case body 4 with the sealing face 10 of the lid body 5 by the pressing function, a lead-out portion 34 through which the heater H is passed is formed in the lid body 5 of at least one of the lid portions f, and the fluid supplying/discharging portions 30, 31 are formed in the lid bodies 5 as portions through which a fluid passing a flow path portion 2 is introduced or discharged, the flow path portion being outside the heater H in the casing 1.

According to the invention, hermetical seal can be attained by a simple operation of fastening the union nut to the end portion of the lid body via the sealing portion in which the end portion of the case body and the sealing face of the lid body are closely contacted with each other. Unlike the conventional art, without using metal fastening members such as tie rods or through-bolts, and O-rings, therefore, a fluid heater in which the number of components is reduced, which is economical, and which has a compact casing structure of high pressure resistance, and a highly reliable sealing structure can be obtained.

The fluid heater of the invention can be provided with a pressure-tight sealing structure in which, unlike the conventional casing connecting structure, tie rods or through-bolts are not used, and a slim casing structure can be realized, and the sealing property can be uniformly ensured by refastening a single union nut. Namely, a sealing structure which is higher in reliability than the case where tie rods or through-bolts are used can be obtained simply by sealing each of the connecting portions between the end portions of the case body and the lid members with the single union nut. Moreover, the fluid heater can be miniaturized and compactly formed by the slim casing. The sealing property can be ensured at any time by refastening the union nuts, and hence the reliability is maintained to be high for a longer term as compared with the case where thread sealing or O-ring sealing is used. It is necessary only to provide simple means that the single union nut is refastened. Unlike the connecting structure due to welding, therefore, the work on the site is facilitated, and maintenance and inspection on the site can be easily conducted.

In the fluid heater of the invention, since a metal member or a rubber O-ring is not used in the case body and the lid bodies which are portions (liquid-contacting portions) contacting with a fluid, it is possible to solve the problems of metal elution and production of metal abrasion powder. When the union nut is fastened, the whole outer circumference of the end portion of the case body can be uniformly pressed, and hence the case body and the lid body are prevented from being accidentally deformed. Therefore, it is possible to solve the problems of creep and replacement of these members. When the union nut is loosened, the lid body can be easily detached from the end portion of the case body. Therefore, stagnate fluid which stagnates in the case body can be easily removed away.

In the fluid heater of the invention, even when an internal pressure arises in the case body, the air tightness can be maintained simply by the fastening of the union nut, and fluid leakage can be prevented from occurring. Unlike the conventional art, therefore, the use of an O-ring can be eliminated, and all the components of the casing can be molded of a fluororesin. As a result, the fluid heater can sufficiently cope with a high-temperature and strong corrosive chemical, and can be applied to and installed in a chemically resistant ambient. Therefore, the application range of the fluid heater can be widened.

The invention is characterized in that, in the fluid heater, a heating portion 40 of the heater H is placed only in an interior of the casing 1 which forms the flow path portion 2.

The invention can attain the following functions and effects. When a heater in which a heating portion is formed in a substantially whole range of the casing including the lead-out portions of the lid bodies is used, for example, not only the interior of the casing but also the lead-out portions of the lid bodies are heated, and therefore waste heating is caused. This is inconvenient. By contrast, when a configuration in which a heating portion is placed within the range specified in the invention is employed, the lead-out portions of the lid bodies are not wastefully heated while exerting an effective heating function on a fluid in a heating chamber (the inner space of the casing) formed by the casing and the heater. Therefore, an advantage that a rational and economical fluid heater can be produced is attained.

The invention is characterized in that, in the fluid heater, each of the sealing portions S is formed by close contact between: a sealing face 10 configured by forming a tapered face in a position inner than an inlet of the receiving port 8, the tapered face having a diameter which is gradually increased toward an outer side in an axial direction of the lid body 5; and a projection end face 22 formed by a tapered face which is formed in a tip end of a projection portion 17 of an inner ring 15, the projection portion being projected from the end portion of the case body 4, the inner ring being pressingly inserted into the end portion of the case body 4 to increase a diameter of the end portion into a mountain-like section shape.

The invention is characterized in that, in the fluid heater, each of the sealing portions S is formed by pressingly holding the end portion of the case body 4 in an inclined state between: a sealing face 11 which is formed in an inlet of the receiving portion 8 of the lid body 5 by a tapered face intersecting with an axis of the lid body 5; and an inward tapered face 20 which is formed on an inclined face of a press-insertion portion of an inner ring 15 which is pressingly inserted into the end portion of the case body 4 to increase a diameter of the end portion into a mountain-like section shape.

The invention is characterized in that, in the fluid heater, each of the sealing portions S is formed by making a cylindrical portion 24 fittable into an annular groove 13, the cylindrical portion being formed in a tip end of a projection portion of the inner ring 15 pressingly inserted into the end portion of the case body 4, the annular groove being formed in an radially outer side with respect to the sealing face 10 that is formed in an inner portion of the receiving portion 8 of the lid body 5, and elongating parallel to an axis of the lid body 5.

According to the invention, the function of satisfactorily sealing the interfaces between the case body and the lid bodies by fastening the union nuts is further enhanced by using the inner rings which are externally fitted and pressingly inserted in the state where the end portions of the case body are expanded. Therefore, it is possible to provide a fluid heater having a casing which is free from liquid leakage for a long term, and which is highly reliable.

The invention is characterized in that, in the fluid heater, the lid portion f attached to one of the end portions of the case body 4 is identical with the lid portion f attached to the other end portion.

According to the invention, the two lid portions in total which are attached to the respective end portions of the case body are identical with each other, and hence the lid portions are configured by parts of one kind. Therefore, no assembly error occurs in an assembling step, and parts management is advantageously performed. As result, it is possible to provide a fluid heater which is superior in cost and productivity.

The invention is characterized in that, in the fluid heater, the case body 4 and the lid portions f are made of a fluororesin.

According to the invention, all the components of the casing can be molded of a fluororesin. As a result, the fluid heater can sufficiently cope with a high-temperature and strong corrosive chemical, and can be applied to and installed in a chemically resistant ambient. Therefore, the application range of the fluid heater can be widened.

The invention is characterized in that, in the fluid heater, the heater H is a cartridge heater 39 which is covered by a fluororesin material.

The invention is characterized in that, in the fluid heater, the heater H is a lamp heater 53 which is covered by a fluororesin material.

According to the invention, since the heater wire is covered by a fluororesin material, the heater wire is protected from being in direct contact with a fluid, and substantially no adverse effect is produced. Consequently, there is an advantage that the durability of the heater can be improved.

The invention is characterized in that, in the fluid heater, the heater H is a coil heater in which a heating wire 40 covered by a fluororesin material is spirally wound.

According to the invention, since a coil heater configured by spirally winding a heating wire is used, the length of the heating wire in the casing can be increased without effort, whereby a fluid heater having an improved heating efficiency can be provided. According to the invention, since the heater wire covered by a fluroresin material is protected from being in direct contact with a fluid, and substantially no adverse effect is produced. Consequently, there is an advantage that the durability of the heater can be improved.

In the invention, in the fluid heating apparatus, a plurality of the fluid heaters A are combined with one another, and the fluid supplying/discharging portions 30, 31 of the fluid heaters A are communcatingly connected to each other to, in each of the fluid heaters A, allow a fluid to pass through an interior of the casing 1.

According to the invention, various usages are enabled. For example, a plurality of fluid heaters are connected in parallel to cope with a large flow rate, fluid heaters are connected in series to further raise the heating temperature, or the apparatus is used as a terminal to which plural paths in a fluid pipe system are collected. Therefore, it is possible to provide a fluid heating apparatus which can be used more conveniently.

The invention is characterized in that, in the fluid heating apparatus, the lid portions f are configured to enable a plurality of the case bodies 4 to be detachably attached to the lid portions f, whereby the fluid heaters A are combined to each other to, in each of the fluid heaters A, allow a fluid to pass through the interior of the casing 1.

According to the invention, a plurality of fluid heaters can be connected by using one lid portion in one side, i.e., two lid portions in total. It is possible to provide a rationalized fluid heating apparatus which can attain the same functions and effects as those of the above-mentioned fluid heating apparatus while the structure can be simplified, the number of components can be reduced, and the size can be reduced as compared with the above-mentioned fluid heating apparatus.

DETAILED DESCRIPTION OF THE PREFERRED EMBODIMENTS

Figure 14:
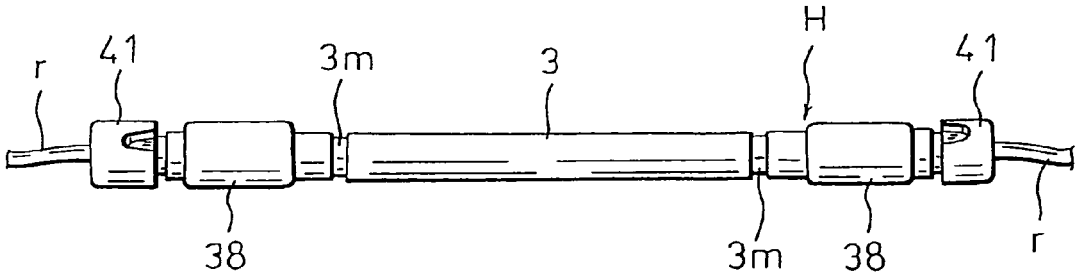
FIG. 14 is an external view of a rod-like hater using a quartz tube.
Figure 15:
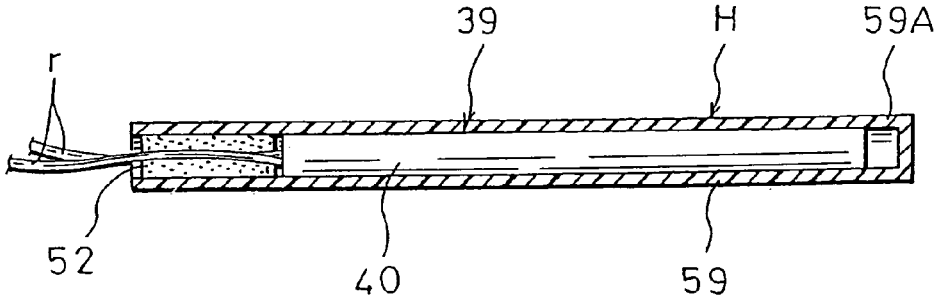
FIG. 15 is a section view of a rod-like heater used in the fluid heater of Embodiment 4.

Hereinafter, embodiments of the fluid heater and fluid heating apparatus of the invention will be described with reference to the accompanying drawings. FIGS. 1 to 5 are various views related to a fluid heater of Embodiment 1 and a sealing structure, FIG. 6 is a view showing the structure of a fluid heater of Embodiment 2, FIGS. 7 to 13 and FIGS. 16 to 20 are various views showing fluid heaters and a fluid heating apparatus of Embodiments 3 to 10, and a sealing structure, and FIGS. 14 and 15 are views for reference showing various heaters.

Embodiment 1

Figure 1:
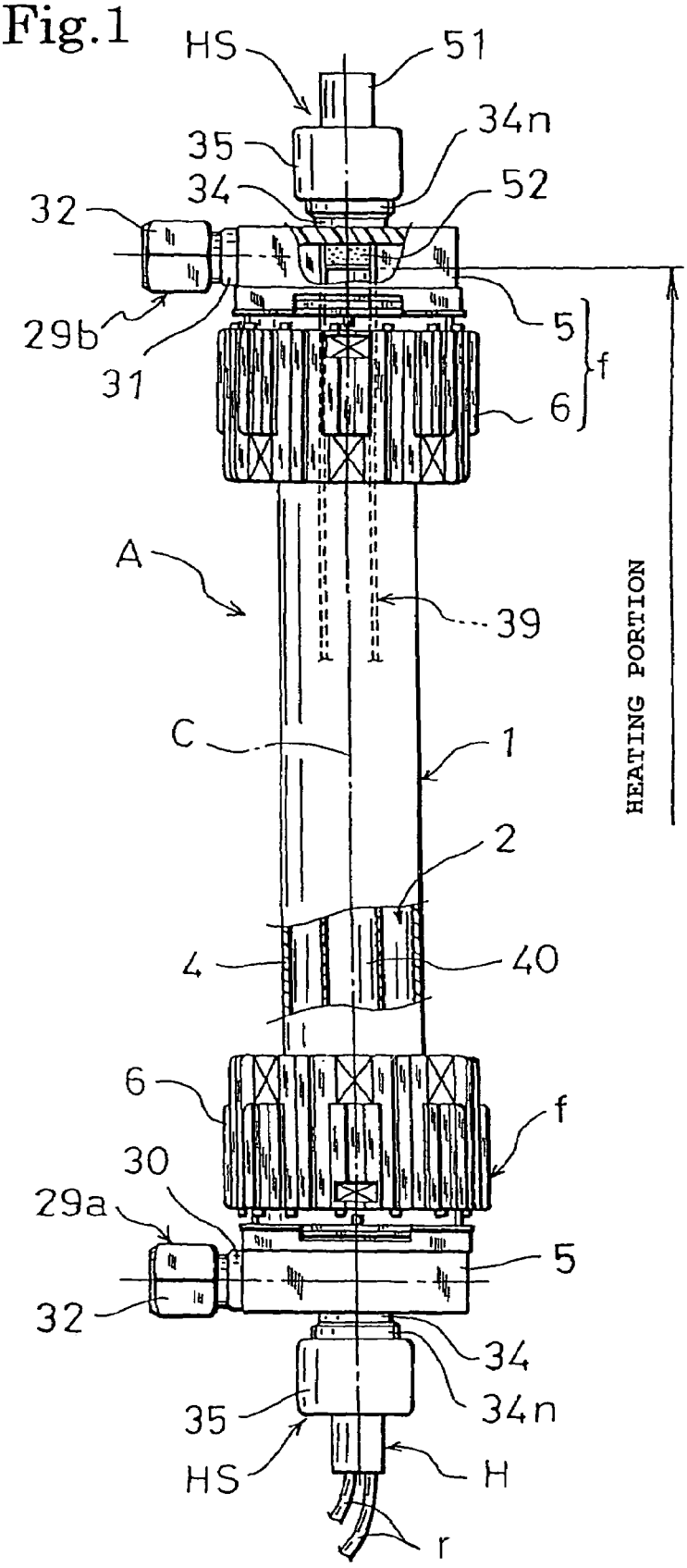
FIG. 1 is a front view of a fluid heater of Embodiment 1.
Figure 2:
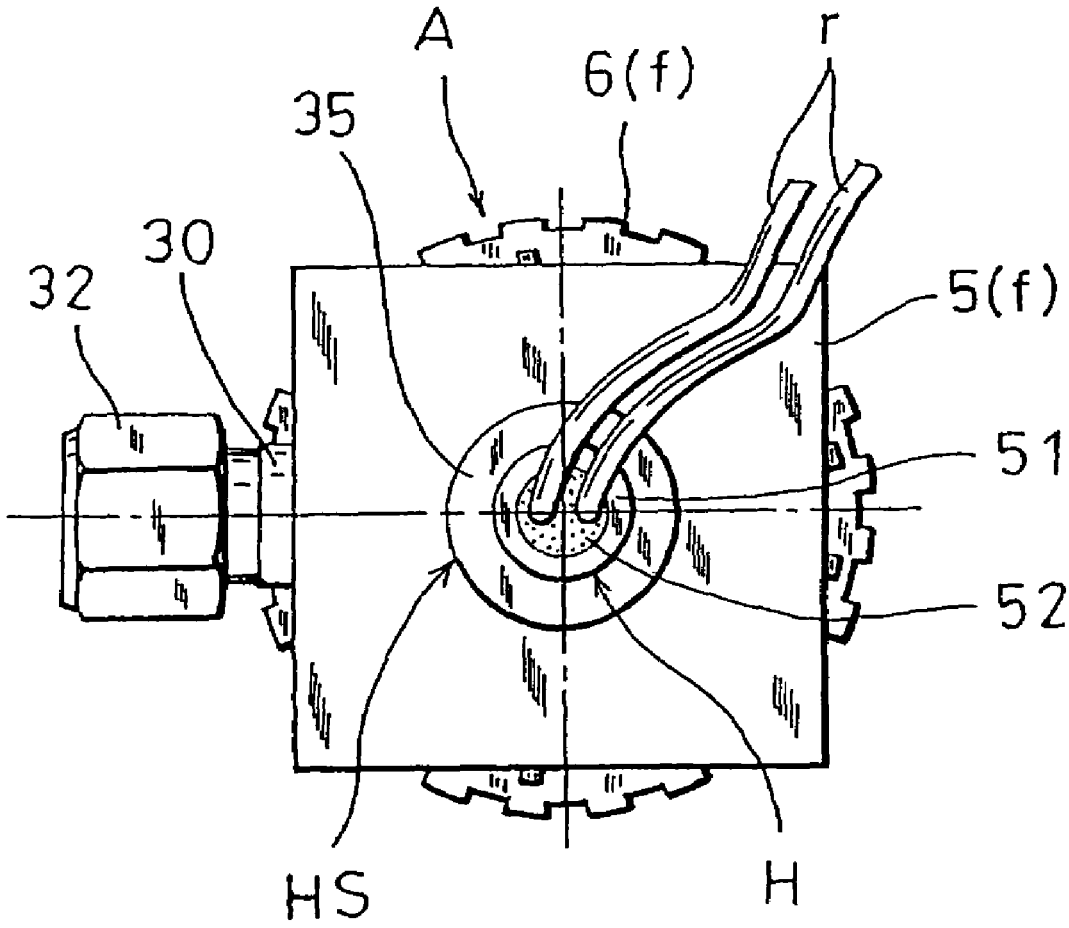
FIG. 2 is a bottom view of the fluid heater of FIG. 1.
Figure 3:
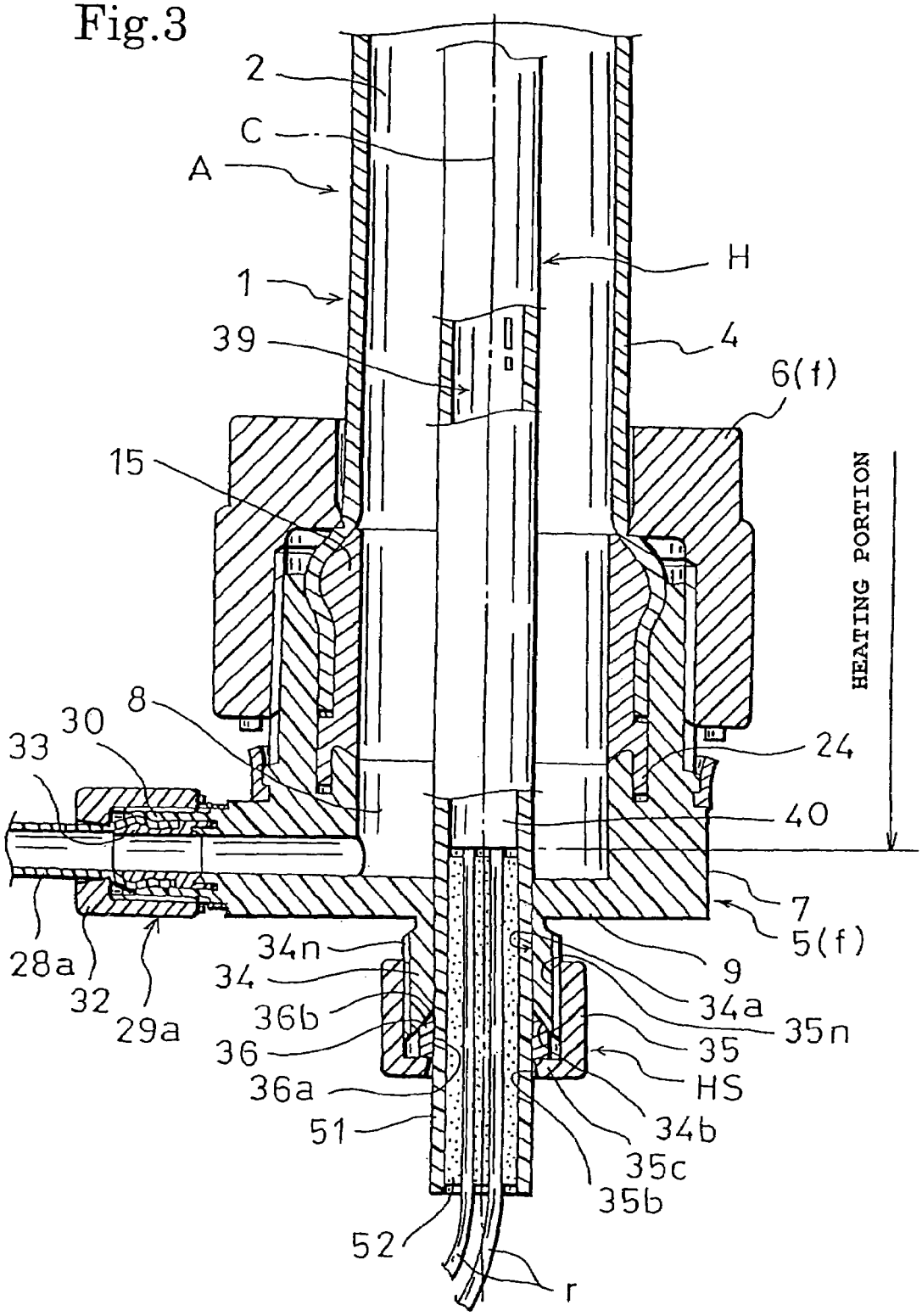
FIG. 3 is an enlarged section view of main portions showing the structure of a casing end portion in FIG. 1.

As shown in FIGS. 1 to 3, a fluid heater A of Embodiment 1 is a fluid heater of the vertical type in which a fluid passing through the interior of a casing 1 can be heated by a rod-like heater (an example of a heater) H that is passed through the casing 1 and placed inside the casing 1 The fluid heater is used with being incorporated in a vertical posture in a pipe system for ultrapure water for cleaning in an apparatus for producing a semiconductor device (inline heater). The fluid heater A has: the casing 1 configured by a case body 4 formed by a tube member, and lid portions f which are detachably attached to respective end portions of the case body 4 to close the end portions; and a rod-like heater H which is passed through the lid portions f to be placed in the interior of the case body 4, and fluid supplying/discharging portions 30, 31 for an inner space 2 of the case body 4 are formed in the lid portions f, respectively.

The case body 4 is configured by a tube member made of a synthetic resin, for example, a fluororesin having excellent heat resistance and chemical resistance, such as PFA or PTFE, or an antistatic fluororesin containing an electrically conductive material, and used with being cut into a predetermined length which is determined in accordance with a preset internal capacity. Lid bodies 5 which are similarly made of a synthetic resin such as a fluororesin are inserted into the ends of the case body 4, respectively, and connected to the ends via fastenings due to union nuts 6 made of a synthetic resin such as a fluororesin. Namely, each of the lid portions f is configured by the lid body 5 and the union nut 6.

Figure 4:
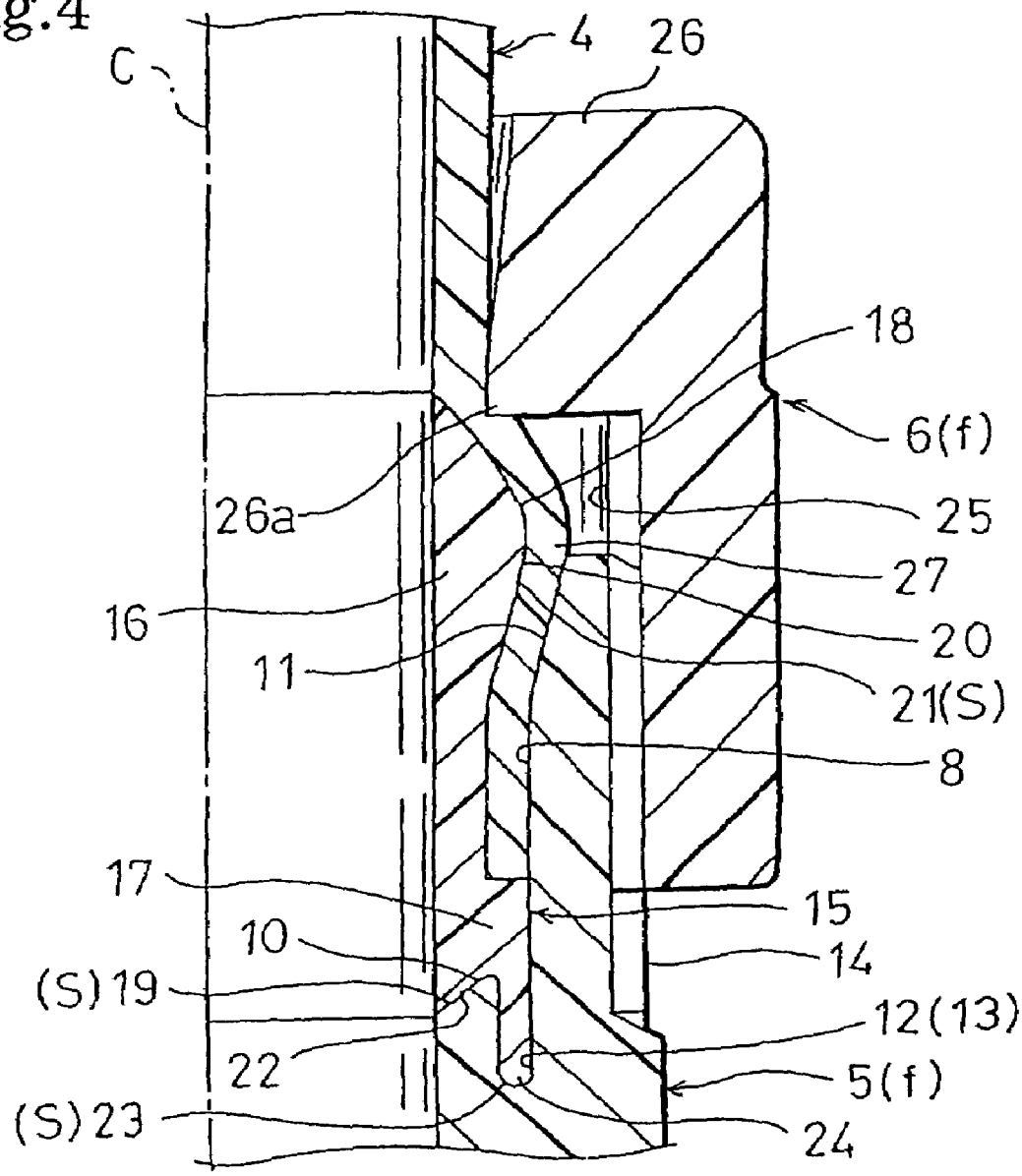
FIG. 4 is an enlarged half section view showing the structure of connecting the casing end portion in FIG. 1 and a lid portion.

In Embodiment 1, the upper and lower lid portions f, or the lid bodies 5, the union nuts 6, and inner rings 15 (described later) are paired components identical to each other. Among the components, the lid bodies 5 having a complicated structure will be described with taking the lower lid body 5 as an example. The lid body is formed into a shape having: a body wall portion 7; a receiving portion 8 which is opened in the upper end (one end) of the body wall portion 7; and a bottom wall portion 9 which closes the lower end (other end) of the body wall portion 7. As shown in FIG. 4, first to third sealing faces 10 to 12 are disposed inside the receiving portion 8 of the lid body 5. The first sealing face 10 is configured by a tapered face which is formed inner than the inlet of the receiving portion 8 of the lid body 5, and in which the diameter is gradually increased so as to intersect with the axis C of the lid body 5, or toward the outer side in the direction of the axis C. The second sealing face 11 is configured by a tapered face which is formed in the inlet of the receiving portion 8, and in which the diameter is gradually increased so as to intersect with the axis C, or toward the outer side in the direction of the axis C. The third sealing face 12 is configured by an annular groove 13 which is formed in an inner portion of the receiving portion 8 of the lid body 5 and in the radially outer side with respect to the first sealing face 10, and which elongates parallel to the axis C. An external thread portion 14 is formed on the outer periphery of the receiving portion 8 of the lid body 5.

On the other hand, the inner rings 15 made of a synthetic resin such as a fluororesin are pressingly inserted into the one and other end portions of the case body 4, respectively. As shown in FIG. 4, the inner rings 15 are formed into a sleeve-like shape having: a press-insertion portion 16 which has an abacus bead-like section shape, and which is to be pressingly inserted into the corresponding end portion of the case body 4 to increase the diameter of the end portion, thereby expanding the end portion so as to have a mountain-like section shape; and a projection portion 17 which is continuous to the press-insertion portion 16, and which projects from the end portion of the case body 4. In the press-insertion portion 16 having a mountain-like section shape, an outward tapered face 18 is formed on one inclined face of the portion, and an inward tapered face 20 which cooperates with the second sealing face 11 to pressingly hold the end portion of the case body 4 in an inclined state to form a second sealing portion 21 is formed on the other inclined face. A projection end face 22 formed by a tapered face which butts against the first sealing face 10 to be in close contact therewith to form a first sealing portion 19, and a cylindrical portion 24 which is to be fitted into the annular groove 13 to form a third sealing portion 23 are formed in the tip end of the projection portion 17. The inner diameter of the inner ring 15 is set to be equal to or substantially equal to that of the case body 4, thereby allowing a fluid to smoothly flow without stagnating.

As shown in FIG. 4, an internal thread portion 25 which is to be screwed with the external thread portion 14 of the lid body 5 is formed in the internal periphery of the union nut 6, an annular flange 26 is inwardly projected from one end portion of the union nut, and a pressing edge 26*a* having an acute or right angle is disposed in an axially inner end of the inner peripheral face of the annular flange 26.

The end portion of the case body 4 into which the inner ring 15 is pressingly inserted into the receiving portion 8 of the lid body 5, and the internal thread portion 25 of the union nut 6 which is previously loosely fitted to the outer periphery of the end portion of the case body 4 is screwed with the external thread portion 14 of the lid body 5 to be fastened up. In accordance with this fastening, the pressing edge 26*a* of the union nut 6 butts against an expansion basal portion of a large-diameter portion 27 of the case body 4 to axially press the inner ring 15. As a result, as shown in FIG. 4, the projection end face 22 of the inner ring 15 is pressed against the first sealing face 10 of the lid body 5 to form the first sealing portion 19, and the end portion of the case body 4 is pressingly held in an inclined state between the inward tapered face 20 of the inner ring 15 and the second sealing face 11 of the lid body 5, thereby forming the second sealing portion 21. Furthermore, the cylindrical portion 24 of the inner ring 15 is pressingly inserted into the annular groove 13 to form the third sealing portion 23. The first to third sealing portions 19, 21, 23 (all indicated by S) exert a sealing function of high reliability. The sealing portions withstand a liquid pressure of about 7 kg/cm$^2$, and have a sufficient pressure resistance to a liquid in a usual liquid supply line (4 kg/cm$^2$)

As shown in FIG. 3, the lid body 5 of the lower lid portion f of the case body 4 comprises an inlet connecting portion 29*a* to which an inlet pipe 28*a* for a fluid that is to heated by the heater H is to be connected, and the lid body 5 of the upper lid portion f comprises an outlet connecting portion 29*b* to which an outlet pipe 28*b* for the fluid that is heated by the heater H is to be connected. The connecting portions 29*a*, 29*b* which are to be connected to other pipes are configured in the following manner. The fluid supplying/discharging portion (inlet port) 30 in the fluid supply side is formed in the body wall portion 7 of the lower lid body 5, and the fluid supplying/discharging portion (outlet port) 31 in the fluid discharge side is formed in the body wall portion 7 of the upper lid body 5. An end portion of the inlet pipe 28*a* for a fluid to be heated is connected to the fluid supplying/discharging portion 30 in the fluid supply side, and that of the outlet pipe 28*b* for a heated fluid is connected to the fluid supplying/discharging portion 31 in the fluid discharge side, via a union nut 32 and an inner ring 33 which are made of a synthetic resin such as a fluororesin, respectively. According to the configuration, the fluid to be heated flows in the sequence of the fluid supplying/discharging portion 30 in the fluid supply side, a heating chamber 2 in the case body 4 (an example of a flow path portion outside the rod-like heater H in the casing 1), and the fluid supplying/discharging portion 31 in the fluid discharge side.

The internal structures of the fluid supplying/discharging portion 30 in the fluid supply side and the fluid supplying/discharging portion 31 in the fluid discharge side are configured in the same manner as the internal structures (except the diameters) of the receiving portions 8 of the lid bodies 5. The inner rings 33 which are identical in section shape as the inner rings 15 for the end portions of the case body 4 are pressingly inserted into end portions of the fluid inlet and outlet pipes 28*a*, 28*b*, respectively. In the end portions of the inlet and outlet pipes 28*a*, 28*b*, the structures for connecting with the fluid supplying/discharging portion 30 in the fluid supply side and the fluid supplying/discharging portion 31 in the fluid discharge side are identical with those of the end portions of the case body 4 for connecting with the receiving portions 8 of the lid bodies 5, and hence their detailed description is omitted. As the structures for connecting the end portions of the inlet and outlet pipes 28*a*, 28*b* with the fluid supplying/discharging portion 30 in the fluid supply side and the fluid supplying/discharging portion 31 in the fluid discharge side, alternatively, other means such as that for directly welding or screwing the end portions of the fluid inlet and outlet pipes 28*a*, 28*b* with the fluid supplying/discharging portion 30 in the fluid supply side and the fluid supplying/discharging portion 31 in the fluid discharge side may be employed as the structures for connecting the end portions of the fluid inlet and outlet pipes 28*a*, 28*b* to the fluid supplying/discharging portion 30 in the fluid supply side and the fluid supplying/discharging portion 31 in the fluid discharge side. Namely, the connecting portions 29*a*, 29*b* for other pipes may be realized by connecting means such as welding or screw connection.

Next, the heater H disposed in the casing 1 will be described. In the embodiment, a cartridge heater which is covered by a fluororesin material is used as the rod-like heater H which is passed through the upper and lower lid bodies 5, 5. As shown in FIGS. 1 to 3, the cartridge heater 39 is a known commercial product comprising: a heating portion 40 in which the outer periphery is covered by a metal material such as stainless steel; and a pair of lead wires r, r. Although not illustrated, a heat source such as a nichrome wire or an induction coil is housed in the heating portion 40. An outer sheath tube 51 which is formed by cutting a tube member made of a fluororesin into an adequate length is externally fitted (covers) to the heating portion 40 including portions of the lead wires r, so that the liquid-contacting portion (portion with which the fluid is in contact) of the rod-like heater H in the casing 1 is formed only by the fluororesin.

In the above-mentioned rod-like heater H configured by the fluororesin-coated cartridge heater, the ends are led out to the outside from outlet ports 34*a* formed in lead-out portions (an example of "lead-out portions for the heater) 34 projecting from the bottom wall portions 9 of the upper and lower lid members 5, respectively. The heater is placed in the casing 1 in a state where both the ends are passed through the casing. Union nuts 35 made of a synthetic resin such as a fluororesin are fitted onto the lead-out portions 34 for the rod-like heater H in the lid bodies 5, respectively. Heater connecting portions HS where the union nuts 35 are screwed and fastened to the lead-out portions 34 via fastening rings (ferrules) 36, thereby hermetically sealing the gaps between the outer sheath tube 51 of the rod-like heater H and the lead-out portions 34. Alternatively, a structure may be employed in which a quartz tube is externally fitted to the cartridge heater, and a tube member made of a fluororesin is externally fitted to the quartz tube to cover it.

In each of the heater connecting portions HS, the lead-out portion 34 and the end portion of the outer sheath tube 51 are hermetically communicatingly connected to each other in the following manner. As shown in FIG. 3, the rod-like heater H is inserted into the outlet port 34*a* of the lead-out portion 34 which is formed into a cylindrical shape, and a state where an end portion of the outer sheath tube 51 is slightly exposed to the outside from the lead-out portion 34 is set. Then, the lead-out portion 34 and the union nut 35 which is fitted onto the outer peripheral face of the outer sheath tube 51 are screwed with each other, to be fastened in the direction of pressingly contacting opposing faces of the lead-out portion 34 and the fastening ring 36 which is fitted onto the outer peripheral face of the outer sheath tube 51. The end portions of the outer sheath tube 51 may be filled with a filler 52. Preferably, the filler 52 consists of a material which is relatively hard, and which has a heat insulating property. The heater H may be configured by closely contacting a lining of a fluororesin or PEEK having a thickness of 0.3 to 1.2 mm, to a sheath heater having a cylindrical rod-like shape.

The components 34, 35, 36 constituting the heater connecting portions HS are configured by a resin material having excellent chemical resistance, heat resistance, and pressure resistance in order to transport chemicals such as strong acid or strong alkali. For example, the lead-out portions 34 and the fastening rings 36 are formed by a synthetic resin such as PTFE or PFA, and the fastening union nuts 35 are formed by a synthetic resin such as PFA or PP.

An internal thread portion 35*n* which is screwable with an external thread portion 34*n* formed in the outer periphery of the lead-out portion 34 is formed in the inner peripheral face of each of the union nuts 35, and a through hole 35*b* having an inner diameter which is slightly larger than the outer diameter of the outer sheath tube 51 having the maximum diameter of the rod-like heater H is formed in a center area. A step portion 35*c* which is to butt against the lower end face of the fastening ring 36 is formed in an inner peripheral edge of the through hole 35*b*.

In the fastening ring 36, a through hole 36*a* having a diameter which is slightly smaller than the outer diameter of the rod-like heater H is formed in a center area, and a conical tapered face 36*b* in which the diameter is gradually reduced toward the insertion direction of the rod-like heater H is formed in one side face. The tapered face 36*b* is formed so as to have a shape and dimensions which are coincident with those of a tapered face 34*b* formed in the lead-out portion 34.

In the assembled state where the rod-like heater H is inserted into the casing 1, as shown in FIGS. 1 and 3, the outer sheath tube 51 is preferably formed to be longish so that the heating portion 40 is within the range of the upper and lower bottom wall portions 9, 9. Namely, the heating portion 40 of the rod-like heater H is placed only in the interior (the portion of the case body 4 which is inner than the portion passed through the lead-out portions 34 of the lid body 5) of the casing 1 forming the heating chamber 2 serving as the flow path portion. When a fluorine tube heater having such a fluororesin tube is used, the portion of the fluid heater A contacting with the fluid, i.e., the liquid-contacting portion is formed only by the fluororesin, and there is an advantage that a clean heater in which precipitation of impurities never occurs is obtained. Furthermore, there are the following effects.

When, although not illustrated, a rod-like heater in which the heating portion 40 is formed in a substantially whole range of the outer sheath tube 51 is used, for example, not only the interior 2 of the casing 1 but also the heater connecting portions HS are heated, and there arises the possibility that the lead-out portions 34 and the union nuts 35 which are made of the fluororesin are deformed by heat. Therefore, waste heating is caused, and this is inconvenient. By contrast, when a configuration in which the heating portion 40 is placed within the above-described range is employed, the heater connecting portions HS are not wastefully heated while exerting an effective heating function on a fluid in the heating chamber 2 formed by the casing 1 and the rod-like heater H. Therefore, an advantage that the rational and economical fluid heater A can be produced is attained. Even when the heating portion 40 cannot be fitted within the heating chamber 2, a sensor (e.g., a thermostat) which monitors the surface temperature of, for example, the heater H is disposed, so that temperature rise which is larger than a constant level can be prevented from occurring. In the thus configured fluid heater A, a fluid passing through the interior 2 of the casing 1, such as ultrapure water for cleaning or a chemical liquid used in an apparatus for producing a semiconductor device can be heated by the rod-like heater H without hindering the flow movement. The lid body 5 may be made of a fluororesin such as PTFE or PFA, or quartz.

Other Embodiments of Sealing Portion

In each of the sealing portions formed between the end portions of the case body 4 and the receiving portions 8 of the lid bodies 5, as the structure shown in FIG. 4, the sealing property can be improved more surely by, in addition to the first and second sealing portions 19, 21, further providing the third sealing portion 23 due to the cylindrical portion 24 of the inner ring 15 and the annular groove 13 of the lid body 5. However, the structure of the sealing portion is not restricted to this.

Figure 5:
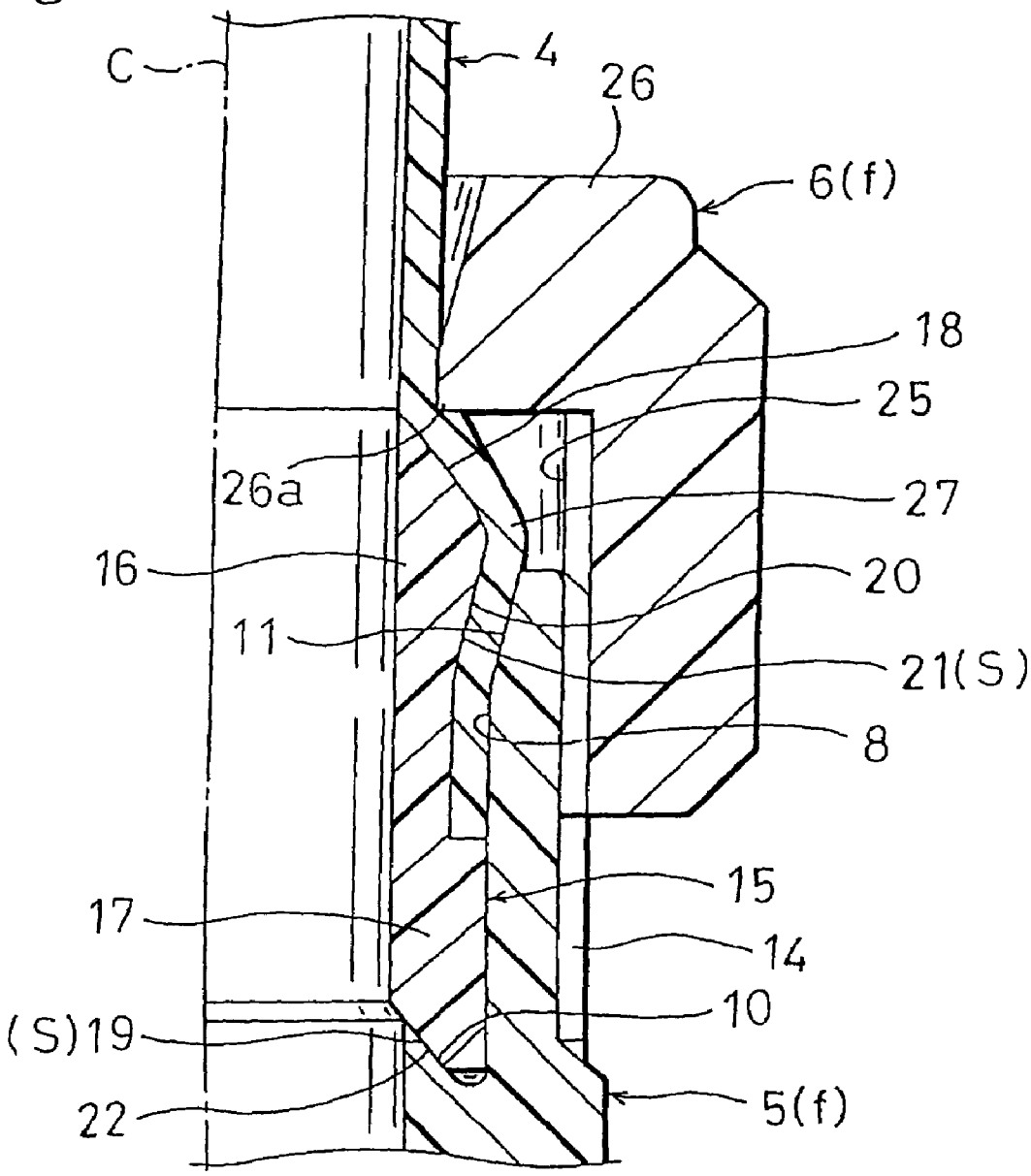
FIG. 5 is a half section view showing another structure of a sealing portion.
Figure 6:
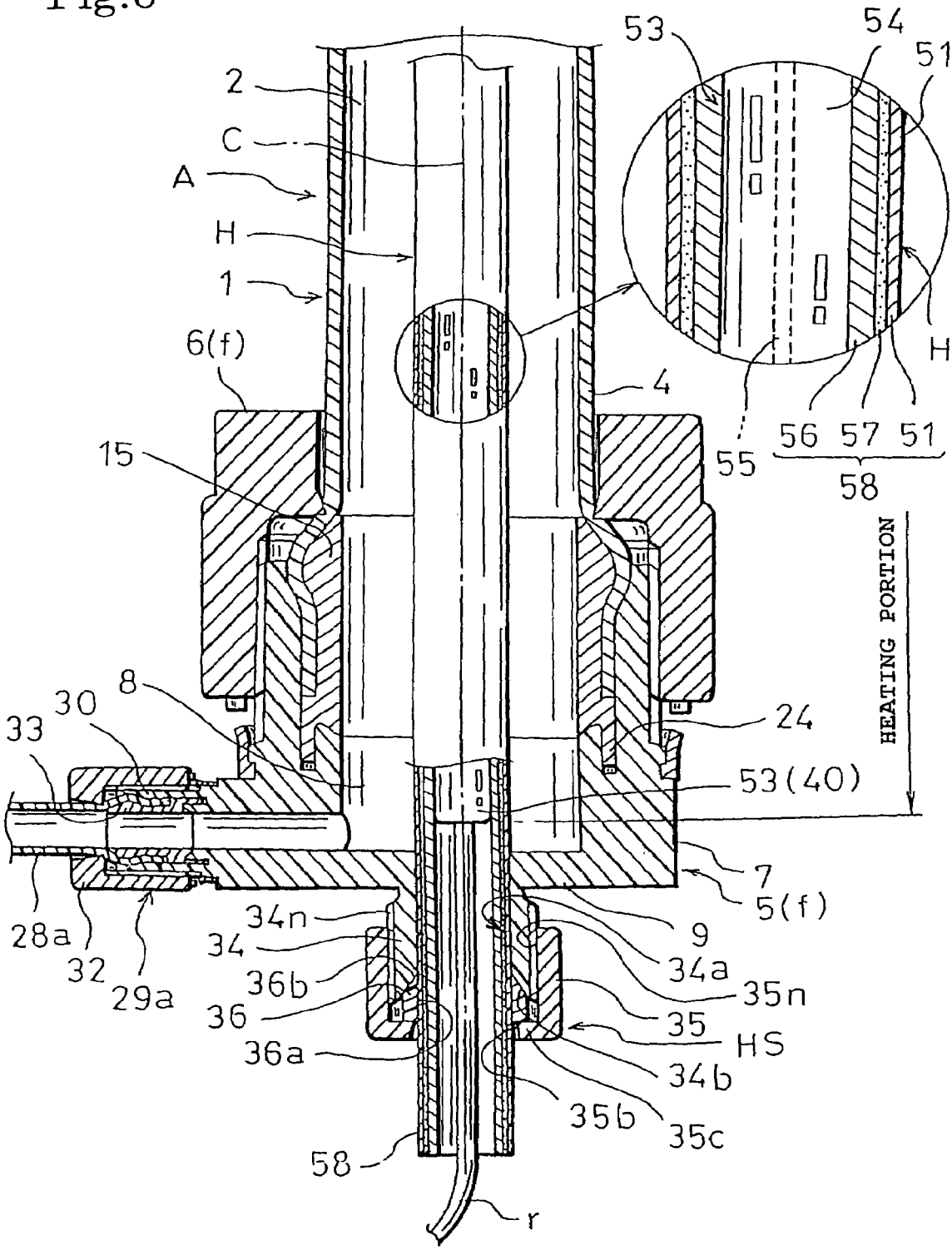
FIG. 6 is a front section view showing main portions of a fluid heater of Embodiment 2.

Alternatively, as shown in FIG. 5, for example, a structure may be employed in which only the first and second sealing portions 19, 21(S) are formed, and the third sealing portion 23(S) is omitted. In the structure, specifically, the annular groove 13 is not formed in an inner portion of the lid body 5, and the cylindrical portion 24 is not disposed in the inner ring 15. In this case, the first sealing face 10 disposed in an inner portion of the lid body 5 is configured by a tapered face in which the diameter is gradually reduced so as to intersect with the axis C in a direction opposite to that of the second sealing face 11, or toward the outer side in the direction of the axis C. When the tapered faces are pressingly contacted with each other by screw advancement of the union nut 6, the faces can be formed as the third sealing portion. Also in this case, the lid body 5 may be made of a fluororesin such as PTFE or PFA, or quartz.

Embodiment 2

A fluid heater A of Embodiment 2 is identical with the fluid heater of Embodiment 1 shown FIGS. 1 to 3 and the like except that the rod-like heater H is configured by a lamp heater. Specifically, as shown in FIG. 6, the rod-like heater H is a lamp heater 53 covered by a fluororesin material, or the cartridge heater 39 of the fluid heater A in Embodiment 1 is replaced with the lamp heater 53. As shown in FIG. 6, the lamp heater 53 is configured by a halogen lamp in which a tungsten filament 55 is housed in a glass tube 54, and inserted into a quartz tube 56 together with lead wires r that are led out one by one from the ends of the glass tube 54, and the quartz tube 56 is inserted into a tube member 51 made of a fluororesin via a close contact layer 57 due to an adhesive agent and the like, thereby constituting the rod-like heater H. Namely, the lamp heater 53 is covered by a cover tube portion 58 configured by the three layers. When a shrinkable fluororesin tube is used, the close contact layer 57 may be omitted.

In this case, the lamp heater 53 corresponds to the heating portion 40. In the same manner as the fluid heater of Embodiment 1, the heating portion 40 is placed only in the casing 1 which forms the flow path portion 2, and does not extend to the lead-out portions 34. The cover tube portion 58 having the three-layer structure is provided with sufficient strength and rigidity. In the fastened end portions in the lead-out portions 34 constituting the heater connecting portions HS, therefore, it is not required to dispose the filler 52 shown in FIG. 3.

Embodiment 3

A fluid heater A of Embodiment 3 is identical with the fluid heater A of Embodiment 1 except that a quartz tube heater is used as the rod-like heater H. In the fluid heater A of Embodiment 3, as shown FIGS. 7 and 8, the rod-like heater (quartz tube heater) H in which a quartz tube 3 is used is passed through the interior of the case body 4. The ends of the rod-like heater H are led out to the outside from the outlet ports 34*a* formed in the lead-out portions 34 projecting from the bottom wall portions 9 of the upper and lower lid members 5, respectively. The heater is placed in a state where both the ends are passed through the casing. The union nuts 35 made of a synthetic resin such as a fluororesin are fitted onto the lead-out portions 34 for the rod-like heater H in the lid bodies 5, respectively. Quartz tube connecting portions SS where the union nuts 35 made of a synthetic resin such as a fluororesin are externally fitted to be screwed and fastened to the lead-out portions 34 via the ferrules 36 and lock rings 37 hermetically seal the gaps between the quartz tube 3 of the rod-like heater H and the lead-out portions 34.

Figure 8:
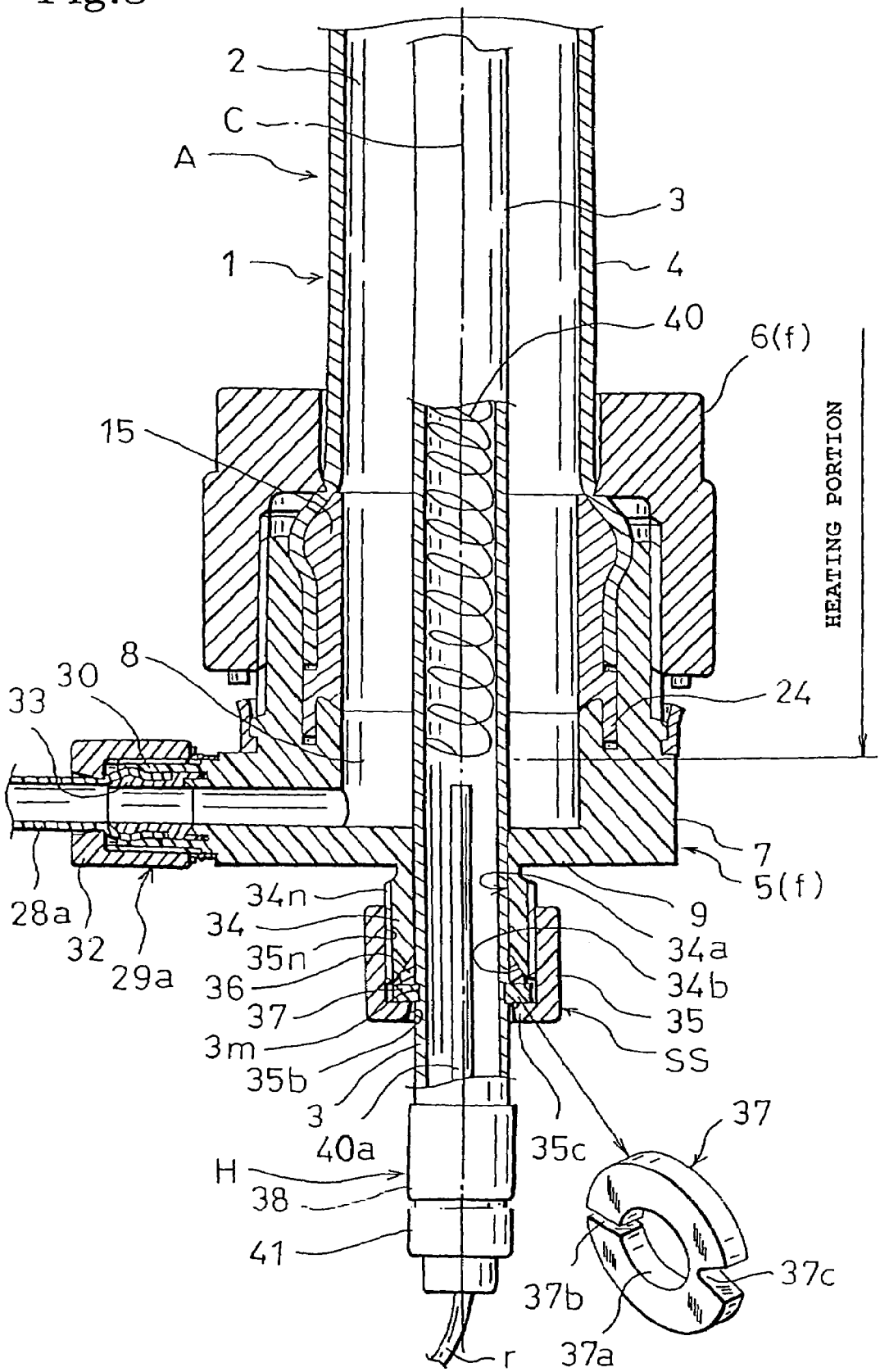
FIG. 8 is a front section view showing main portions of the fluid heater of FIG. 7.

In each of the quartz tube connecting portions SS, the lead-out portion 34 and the end portion of the quartz tube 3 are hermetically communicatingly connected to each other in the following manner. As shown in FIG. 8, the rod-like heater H is inserted into the outlet port 34*a* of the lead-out portion 34 which is formed into a cylindrical shape, and a state where an end portion of the quartz tube 3 is slightly exposed to the outside from the lead-out portion 34 is set. Then, the lead-out portion 34 and the union nut 35 which is fitted onto the outer peripheral face of the quartz tube 3 are screwed with each other, to be fastened in the direction of pressingly contacting opposing faces of the lead-out portion 34, a lock ring 5 fitted into an outer peripheral groove 3*m* of the quartz tube 3, and a fastening ring 6 fitted onto the outer peripheral face of the quartz tube 3. The external thread portion 34*n* which is screwable with the internal thread portion 35*n* formed in the inner peripheral face of the union nut 35 is formed in the outer periphery of the lead-out portion 34.

The components 34, 35, 36, 37 constituting the quartz tube connecting portion SS are configured by a resin material having excellent chemical resistance, heat resistance, and pressure resistance in order to transport chemicals such as strong acid or strong alkali. The lead-out portions 34 and the fastening rings 36 are formed by a synthetic resin such as PTFE or PFA, and the union nuts 35 and locking ring 37 are formed by a synthetic resin such as PFA or PP.

The internal thread portion 35*n* which is screwable with the external thread portion 34*n* formed in the outer periphery of the lead-out portion 34 is formed in the inner peripheral face of each of the union nuts 35, and the through hole 35*b* having an inner diameter which is slightly larger than the outer diameter of a metal cover 38 having the maximum diameter of the rod-like heater H is formed in a center area. The step portion 35*c* which is to butt against the lower end face of the lock ring 37 is formed in an inner peripheral edge of the through hole 35*b*.

In the lock ring 37, a center hole 37*a* having a shape and dimensions which are coincident with those of the peripheral groove 3*m* cut in the outer peripheral face of the quartz tube 3, a split groove 37*b* which radially cuts one end side, and a coupling portion 37*c* which is formed by partially cutting away the outer peripheral portion of the other end side are formed. This shape is configured in order to enable the lock ring 37 to be fitted into the peripheral groove 3*m* after being passed through the quartz tube 3, and can be realized by slightly flexing the coupling portion 37*c* against the elasticity of the material, and radially expanding the center hole 37*a* so that the diameter is slightly larger than the outer diameter of the quartz tube 3.

In the fastening ring 36, the through hole 36*a* having a diameter which is slightly smaller than the outer diameter of the quartz tube 3 is formed in a center area of the fastening ring 36, and the conical tapered face 36*b* in which the diameter is gradually reduced toward the insertion direction of the quartz tube 3 is formed in one side face of the fastening ring 36. The tapered face 36*b* is formed so as to have a shape and dimensions which are coincident with those of the tapered face 34*b* formed in the lead-out portion 34.

Figure 7:
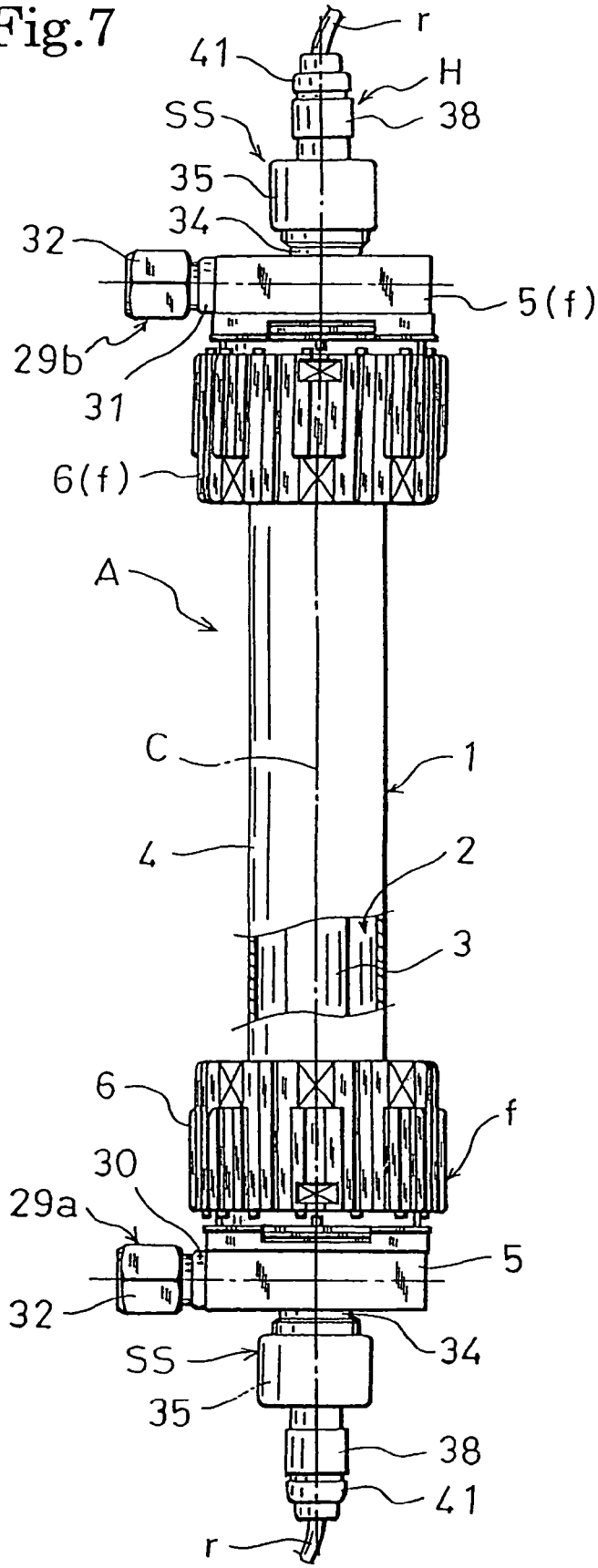
FIG. 7 is a front view of the whole of a fluid heater of Embodiment 3.
Figure 11:
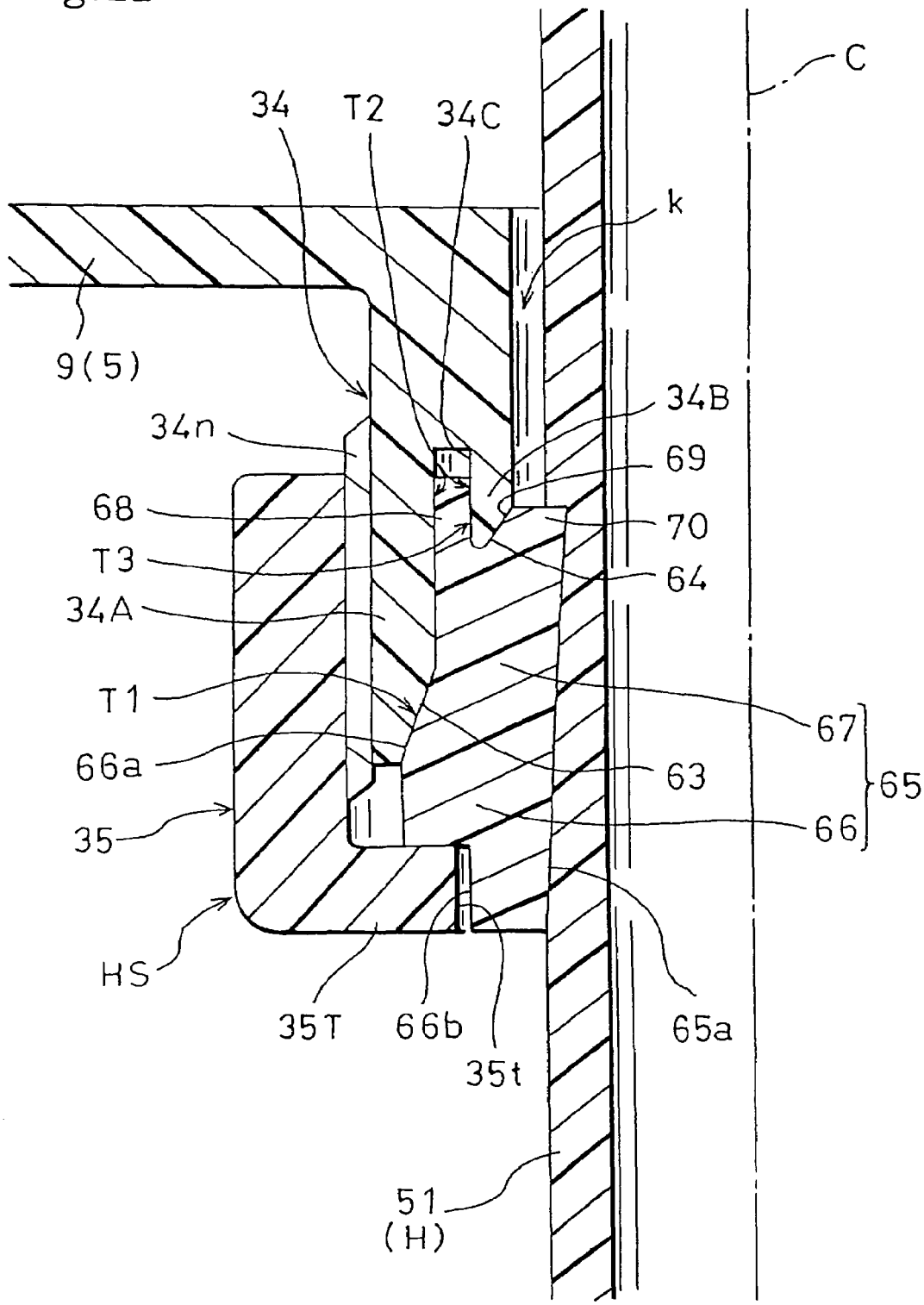
FIG. 11 is a half section view showing a sealing structure of a lower lid portion in FIG. 10.

As shown in FIGS. 7, 11, and 14, the quartz tube heater H is configured by: the cylindrical quartz tube 3 which accommodates the heating portion (heating body) 40 formed by a nichrome wire, an induction coil, or the like; a pair of metal covers 38 which cover the and portions of the heater, respectively; and glass covers 41 which cover lead terminals (not shown) projecting from the metal covers 38, respectively. From each of the glass covers 41, a lead wire r which is conductively connected to the lead terminal is led out. In an assembled state where the rod-like heater H is passed through the casing 1, the heating portion 40 is positioned by using electrode rods 40*a* and the like with being separated from the end portions of the quartz tube 3 toward the middle so that the heating portion 40 is within the range of the upper and lower bottom wall portions 9, 9. Namely, the heating portion 40 of the rod-like heater H is formed at a position of the case body 4 inner than the portions which are passed through the lead-out portions 34 of the lid bodies 5.

When, although not illustrated, a rod-like heater in which the heating body 40 is formed in a substantially whole range of the quartz tube 3 is used, for example, not only the interior 2 of the casing 1 but also the quartz tube connecting portions SS are heated. Therefore, waste heating is caused, and this is inconvenient. By contrast, when a configuration in which the heating portion 40 is placed within the above-described range is employed, the quartz tube connecting portions SS are not wastefully heated while exerting an effective heating function on a fluid in the heating chamber 2 formed by the casing 1 and the quartz tube 3. Therefore, an advantage that the rational and economical fluid heater A can be produced is attained.

Embodiment 4

Figure 9:
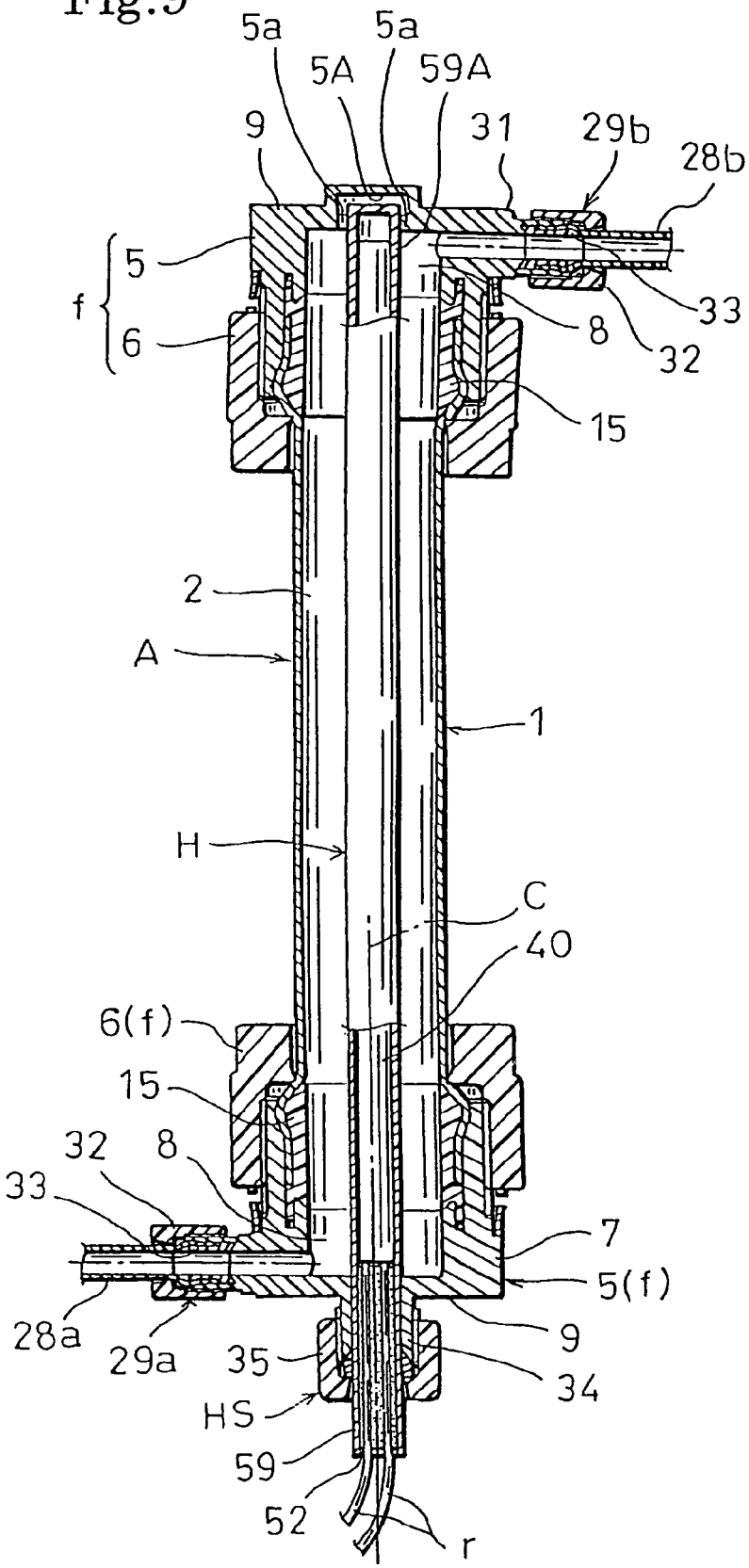
FIG. 9 is a front section view showing a fluid heater of Embodiment 4.

As shown in FIG. 9, a fluid heater A of Embodiment 4 has a single-side passing structure in which the rod-like heater H is passed only through the lid body 5 of the lower lid portion f, and the lid body 5 of the upper lid portion f fittingly supports the upper end portion of a fluororesin tube 59. The fluid heater is different from the fluid heater A of Embodiment 1 in the following points. The upper lid body 5 is not provided with the heater connecting portion HS, and instead a fitting recess 5A is formed. As the rod-like heater H, as shown in FIG. 15, a cartridge heater H that is in a state in which the filler 52 is disposed only in the side where the lead wire r is led out, and that is covered by the outer sheath tube 51. In order to prevent a fluid from stagnating, preferably, the fitting recess 5A has a configuration where the inner diameter is larger than the outer diameter of the rod-like heater H, and the heater is positioned by a plurality of support protrusions 5*a* which laterally protrude.

In the rod-like heater H shown in FIG. 15, the cartridge heater 39 is covered by a tubular tube 59 in which the tip end is closed, and which is made of a fluororesin. The cartridge heater 39 itself is identical with that of Embodiment 1 shown in FIGS. 1 to 3. In the closed-side end portion 59A of the fluororesin tube 59, the position of the cartridge heater 39 is set so as to be slightly separated from the end, and the heating portion 40 is placed only in the interior of the casing 1 which forms the flow path portion 2. In the assembled state where the rod-like heater H is installed into the casing 1, the closed-side end portion 59A of the tip end of the fluororesin tube 59 is fitted into the fitting recess 5A of the upper lid body 5, and positioned so as not to be moved in a radial direction of the casing 1. The other structure is basically identical with that of the fluid heater A of Embodiment 1. In this case, the upper and lower lid bodies 5, 5, i.e., the lid portions f, f are different components.

In the fluid heater A having the single-side passing structure, the rod-like heater H is not passed through the upper lid body 5, and hence there is no possibility that fluid leakage from the lid body occurs. Furthermore, the rod-like heater H does not protrude upward, and hence the size can be correspondingly reduced. Since the lead wires r, r are collected in the lower side, there is another advantage that electric wirings can be simplified. Alternatively, the usage may be performed in which the rod-like heater H of the single-side terminal type is passed only through the upper lid body 5 and attached in an inverted posture to the casing 1.

Embodiment 5

Figure 10:
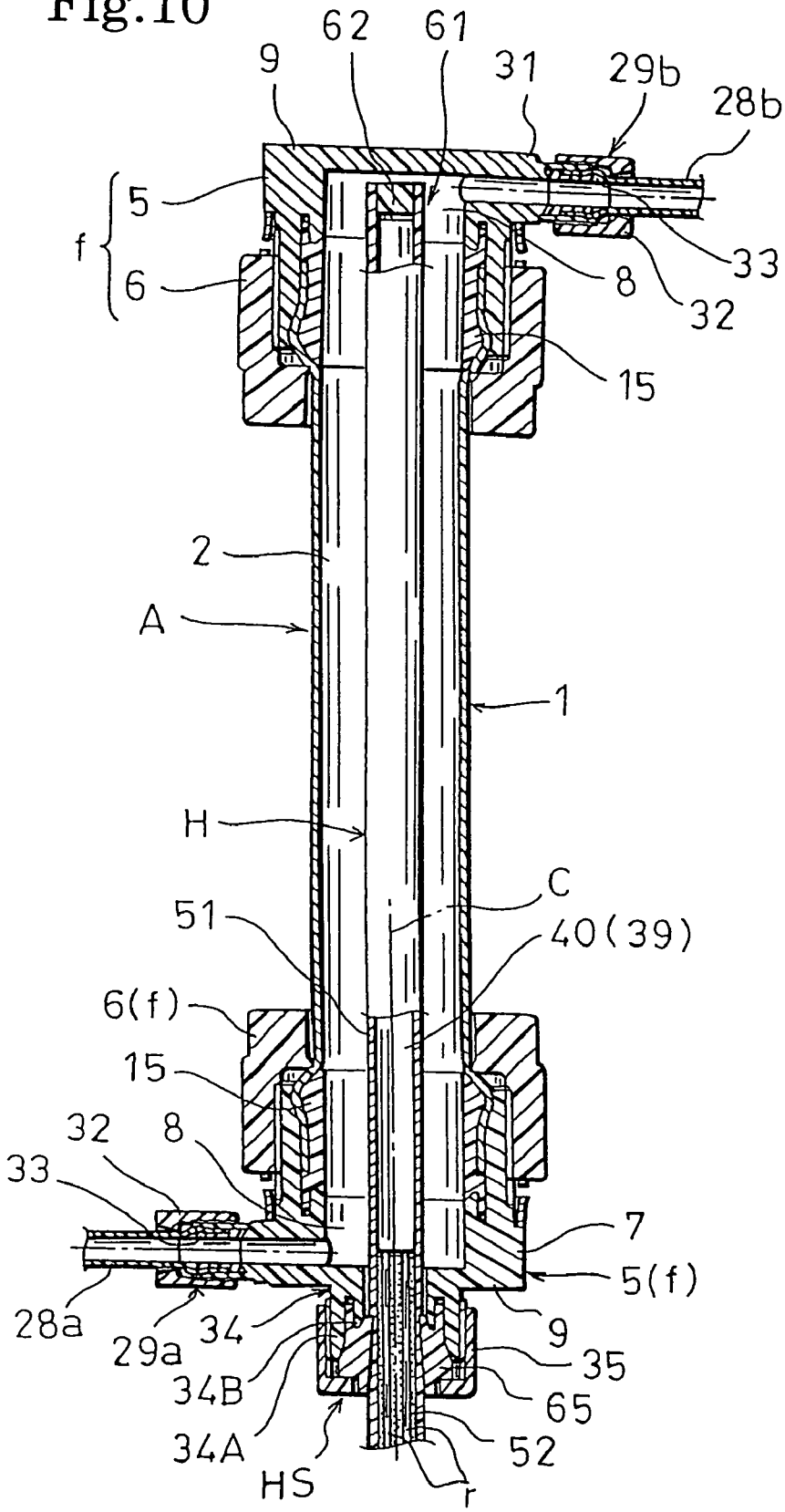
FIG. 10 is a front section view showing a fluid heater of Embodiment 5.

A fluid heater A of Embodiment 5 is a fluid heater of the single-side passing type in the same manner as that of Embodiment 4, but different in sealing structure in the lead-out portions 34 for the rod-like heater H and the lower lid body 5. As shown in FIG. 10, the heater connecting portion HS in the lower lid portion f has the same basic structure that the union nut 35 is externally fitted and screwed to the lead-out portion 34 to support the rod-like heater H on the lower lid body 5 in the sealed state, but is largely different in sealing structure. A tip end portion 61 of the rod-like heater H is closed by plugging (pressingly fitting) a circular block 62 made of a fluororesin into the tip end of the outer sheath tube 51 made of a fluororesin, and fusing and integrating them together. The length of the rod-like heater H is set so that the tip end portion 61 is positioned in a state where it is clearly separated from the bottom wall portion 9 of the upper lid member 5.

In the sealing structure of the lower lid body 5, as shown in FIGS. 10 and 11, the lead-out portion 34 is formed by: an annular outer cylindrical portion 34A in which an external thread portion 34*n* is formed in the outer periphery; an annular inner cylindrical portion 34B which is an annular projection that is distinctly smaller than the outer cylindrical portion 34A; and an annular groove 34C which is formed between the outer cylindrical portion 34A and the inner cylindrical portion 34B in a radial direction with respect to the axis C. A tapered inlet sealing portion 63 in which the diameter is gradually increased is formed in a tip end portion of the inner peripheral side of the outer cylindrical portion 34A, and a tapered inner sealing portion 64 in which the diameter is gradually increased is formed in a tip end portion of the inner peripheral side of the inner cylindrical portion 34B.

An annular sealing portion 65 which is fitted to the lead-out portion 34 to form sealing portions T1 to T3 is integrally disposed in a lower end portion of the fluororesin-made outer sheath tube 51 which is externally fitted and attached to the cartridge heater 39. The annular sealing portion 65 has: an inflated portion 66 in which a tapered face 66*a* to butt against the inlet sealing portion 63 is formed in an upper end side; an annular projection 68 which is formed continuously with the tapered face 66*a* so as to be fitted into the annular groove 34C of the lead-out portion 34; and a fitting projection 67 having a second annular groove 69 into which the inner cylindrical portion 34B is fittable, and is made of a fluororesin such as PFA (preferably the same material as that of the outer sheath tube 51).

The annular sealing portion 65 has a tapered inner peripheral face 65*a* in which the diameter is made smaller as advancing toward the upper end, and is pressingly inserted into and fusion-bonded to the outer periphery of the outer sheath tube 51, whereby the portion is integrated with the outer sheath tube 51 in a state where the gap between the portion and the tube is sealed, particularly in a state where the upper end portion of the annular sealing portion 65 is further surely sealed. An upper-end inner cylindrical portion 70 for forming the annular groove 69 is formed in the fitting projection 67. An upper end portion of the inner peripheral face 65*a* corresponding to the inner periphery of the upper-end inner cylindrical portion 70 is fitted most tightly onto the outer sheath tube 51. The presence of the upper-end inner cylindrical portion 70 enables a gap k which is distinct in a radial direction, to be formed between the outer peripheral face of the outer sheath tube 51 and the inner peripheral face of the lead-out portion 34, in an assembled state.

An inward flange 35T of the union nut 35 is used for pushing up an outer diameter end portion 66*c* of the inflated portion 66 from the lower side. In a fastened state where the internal thread portion 35*n* of the inner periphery is screwed to the external thread portion 34*n* of the lead-out portion 34, an inner diameter portion 35*t* of the flange is set to be in a state where the inner diameter portion is fitted to a step outer peripheral portion 66*b* of the inflated portion 66 of the annular sealing portion 65 without forming a substantial gap (with involving a very small gap). In order to obtain an excellent sealing state, preferably, the annular projection 68 is set to have a radial thickness which is larger by a certain degree than the radial gap of the annular groove 34C, and fitted into the groove in a pressingly inserted state.

In the above-described structure, in an assembled state where the union nut 35 is screwed to the lead-out portion 34 and the annular sealing portion 65 (the rod-like heater H) is pushed up to be fitted into the lead-out portion 34, the inlet sealing portion 63 and the tapered face 66*a* are strongly pressingly contacted with each other to form the first sealing portion T1, and the annular projection 68 is fitted into the annular groove 34C to be strongly pressingly contacted therewith, whereby the second sealing portion T2 is formed in two places of the inner and outer peripheries. In this case, the annular groove 34C is deeper than the projection degree of the annular projection 68, and hence the two members 34C, 68 do not butt against each other in the vertical direction. Instead, the inner cylindrical portion 34B and the second annular groove 69 are fitted to each other, and their tapered faces butt against each other to form the third sealing portion T3. Namely, a state where the lead-out portion 34 and the annular sealing portion 65, or the lid body 5 and the outer sheath tube 51 of the rod-like heater H are completely sealed can be obtained by the presence of the three or first to third sealing portions T1 to T3.

Even when the fluid to be introduced into the casing 1 and heated is a toxic chemical liquid or a liquid which should not leak, such as a chemical liquid of high permeability, no leakage from the lead-out portion 34 supporting the rod-like heater H occurs, and the fluid heater A having excellent reliability and durability can be provided. Since the distinct gap k exists between the outer sheath tube 51 and the lead-out portion 34, there is no possibility that a fluid such as a chemical liquid stagnates, and hence the fluid heater can be kept in a clean state. When a strong bending force acts on the rod-like heater H, the inner diameter portion 35*t* of the inward flange 35T and the step outer peripheral portion 66*b* of the inflated portion 66 which are closely placed butt against each other to produce a function of mutually supporting, and the fitting length between the lead-out portion 34 and the outer sheath tube 51 is substantially increased. Consequently, there is an advantage that a function of realizing stable support can be expected. When the union nut 35 is loosened and detached, the rod-like heater H can be easily removed without involving cumbersome disassembling of the lid portion f. Therefore, the fluid heater has also convenience that a failure or specification change of the rod-like heater H can be coped with, i.e., an excellent maintenance property.

Next, although not illustrated, several modifications of the heater connecting portion HS in the rod-like heater H of Embodiment 5 will be described. First, a heater H has a configuration in which the inner peripheral face 65*a* of the annular sealing portion 65 is not a tapered face, and the heater in a state of a constant diameter is externally fitted and pressingly inserted through the outer sheath tube 51, and fused-bonded and integrated therewith. A fluid heater having this structure may be employed. Second, a heater H in which the annular sealing portion 65 and the outer sheath tube 51 are previously integrally formed by machining or molding is used. A fluid heater having this structure may be employed. Third, the annular sealing portion 65 is not used, the outer sheath tube 51 is pressingly inserted and fitted as it is into the lead-out portion 34 (see FIG. 3), and the outer sheath tube 51 and the lead-out portion 34 are welded and integrated in a lower end portion of the lead-out portion 34. A fluid heater having this structure may be employed. The first and second fluid heaters have an excellent maintenance property that the heater H can be easily attached and detached by operating the union nut 35. The third fluid heater has advantages that the lead-out portion 34 can be completely sealed, and that the fluid heater can be configured most economically.

Embodiment 6

Figure 12:
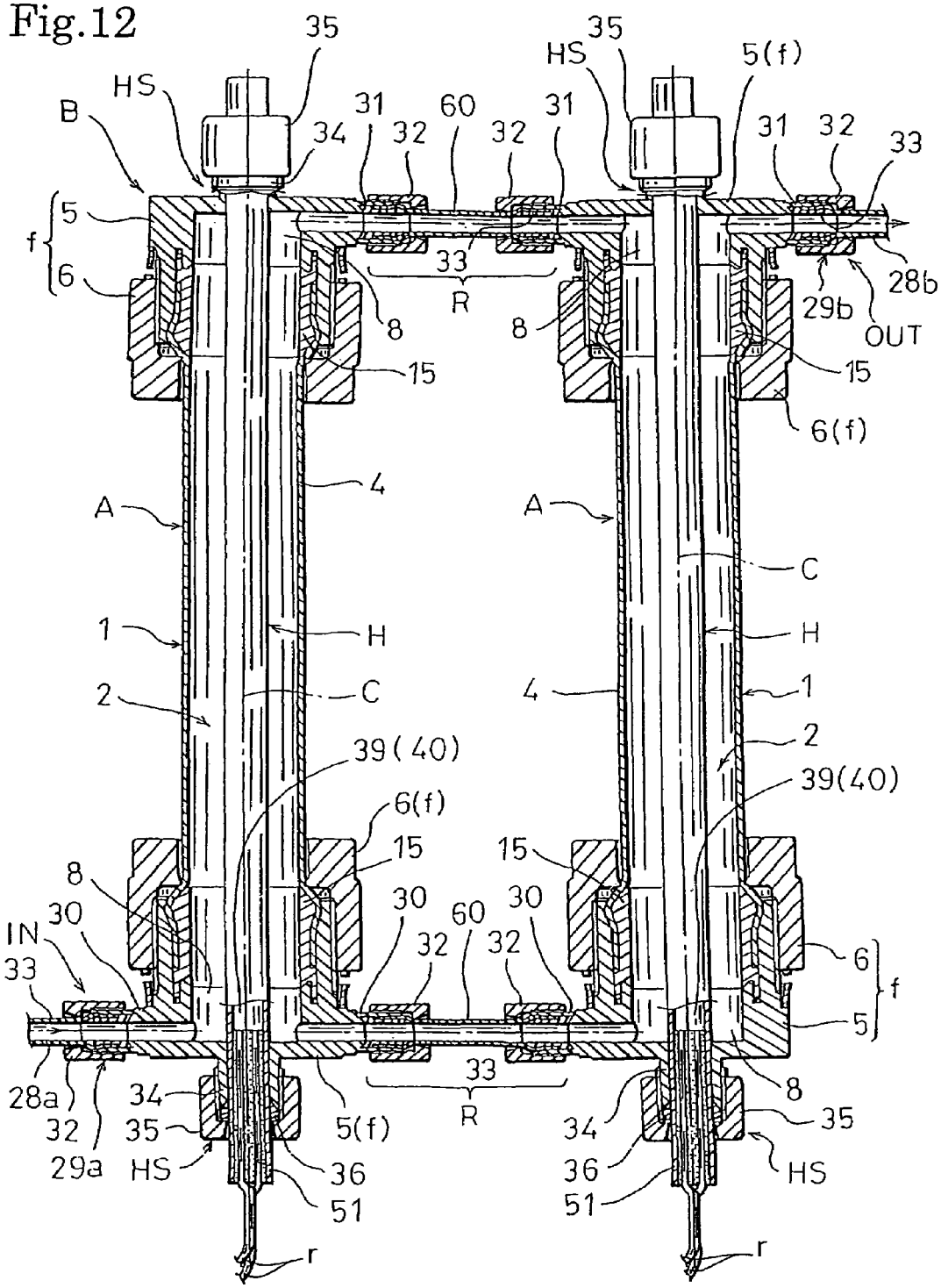
FIG. 12 is a front section view showing a fluid heating apparatus of Embodiment 6.

Embodiment 6 is a fluid heating apparatus B which is configured by connecting a plurality of the above-described fluid heaters A in parallel. In the fluid heating apparatus B of Embodiment 6, as shown in FIG. 12, two fluid heaters A of Embodiment 1 are connected in parallel with using the lid body 5 of one of the lid portions f in which two fluid supplying/discharging portions 30 (or 31) are formed. Referring to FIG. 12, in the left fluid heater A, two fluid supplying/discharging portions 30 are formed in the lower lid body 5, and, in the right fluid heater A, two fluid supplying/discharging portions 31 are formed in the upper lid body 5.

The right fluid supplying/discharging portion 30 of the left lower lid body 5, and the fluid supplying/discharging portion 30 of the right lower lid body 5 are communcatingly connected to each other by a connecting portion R. The left fluid supplying/discharging portion 30 of the left lower lid body 5 plays a role of an inlet IN (inlet collecting portion) for a fluid to be heated. The fluid supplying/discharging portion 31 of the left upper lid body 5, and the fluid supplying/discharging portion 31 of the right upper lid body 5 are communcatingly connected to each other by a connecting portion R. The right fluid supplying/discharging portion 31 of the right upper lid body 5 plays a role of an outlet OUT (outlet collecting portion) for a heated fluid. As shown in FIG. 12, for example, a pipe joint structure configured by a pair of union nuts 32, 32, an intermediate pipe 60 made of a synthetic resin such as a fluororesin, and the like may be employed as the connecting portions R. However, the connecting portions are not restricted to this. For example, pipe portions are formed protrudingly from the lid bodies, and end portions of the pipe portions are butted and fuse-bonded to integrally connect the lid bodies.

The fluid supplied to the inlet IN from the inlet pipe 28*a* is branchingly introduced into the lower end portions of the two heating chambers (heating portion) 2, 2 through the fluid supplying/discharging portions 30 on the supply side and the interiors of the right and left lower lid bodies 5, and upward moved while being heated by the rod-like heaters H in the casings 1. The fluid which has been heated by the fluid heaters A, A and raised to the upper lid bodies 5 is discharged from the outlet OUT to the outlet pipe 28*b* through the fluid supplying/discharging portions 31 on the discharge side and the interiors of the upper lid bodies 5. The fluid heating apparatus B due to the parallel connection of the fluid heaters is adequately used for heating a large amount of fluid. The fluid heating apparatus is a convenient apparatus in which its scale can be easily selected in accordance with the number of connected fluid heaters A, A.

A parallel connection of three or more fluid heaters A can be realized by additionally using a fluid heater in which lid bodies 5 having two fluid supplying/discharging portions 30 (or 31) are disposed respectively in upper: and lower portions. According to a fluid heating apparatus having such a parallel connection, a fluid which is stored in the apparatus can be discharged and supplied after being heated to a fixed temperature. Therefore, it is not required to dispose a liquid tank such as a storage tank, and the apparatus can be produced compact and at a low cost. In the case where, for example, the flow amount is small but the heating temperature is high, a fluid heating apparatus B in which a plurality of fluid heaters A are connected in series is preferably used. A combination of the parallel connection and the series connection is possible.

Embodiment 7

Embodiment 7 is a fluid heater A using a coil heater H in which a heating wire covered by a fluororesin material is spirally wound. Specifically, as shown FIG. 16, the coil heater H in Embodiment 7 is configured by spirally winding a heater element 72 in which a heater wire 40 serving as a heating body is inserted into a tube 71 of a fluororesin such as PFA. The heater element is led out to the outside via heater element connecting portions YS of the lid portions f. A control device (not shown) for power supply is connected to the lead wires r, r at the ends. The heater element connecting portions YS have the same structure as the heater connecting portion HS shown FIG. 3, etc.

Figure 16:
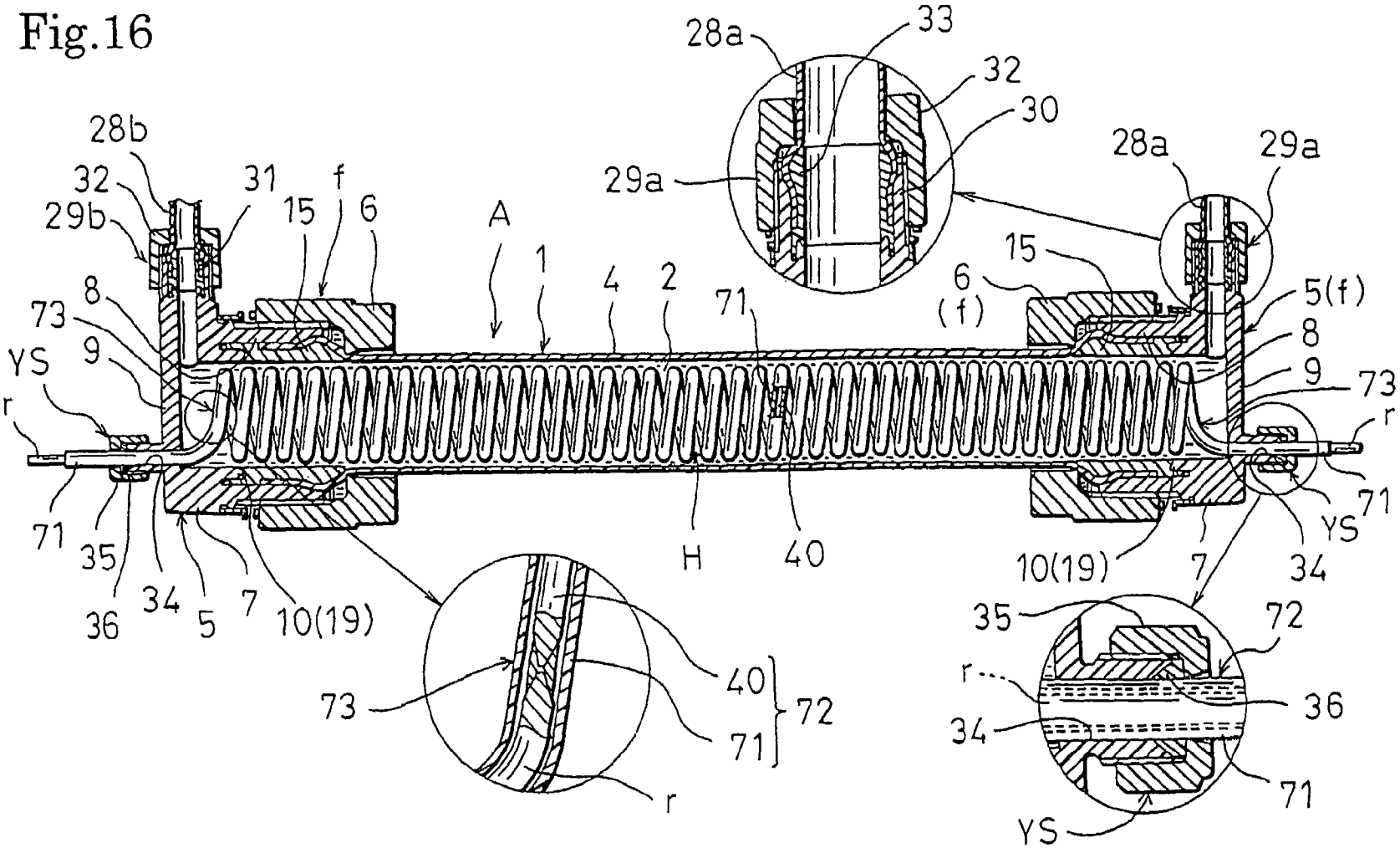
FIG. 16 is a front section view showing a fluid heater of Embodiment 7.

In the heater element 72, as shown in a partially enlarged view of FIG. 16, connecting portions 73 for conductively connecting (by soldering, crimping, or the like) the lead wires r to the heater wire 40 are disposed in the fluororesin tube 71 at positions (inside the casing 1) where the heater wire extends short of the bottom wall portions 9, so as to avoid heat conduction from the heater wire 40 to the heater element connecting portions YS, i.e., the lead-out portions 34. The connecting portions 73 are formed in the lid portions f, respectively. The employment of the coil heater H can largely increase the length of the heater wire 40 in the casing 1. Therefore, there are advantages that the heating temperature is made higher, and that the heating efficiency can be improved.

Embodiment 8

Figure 17:
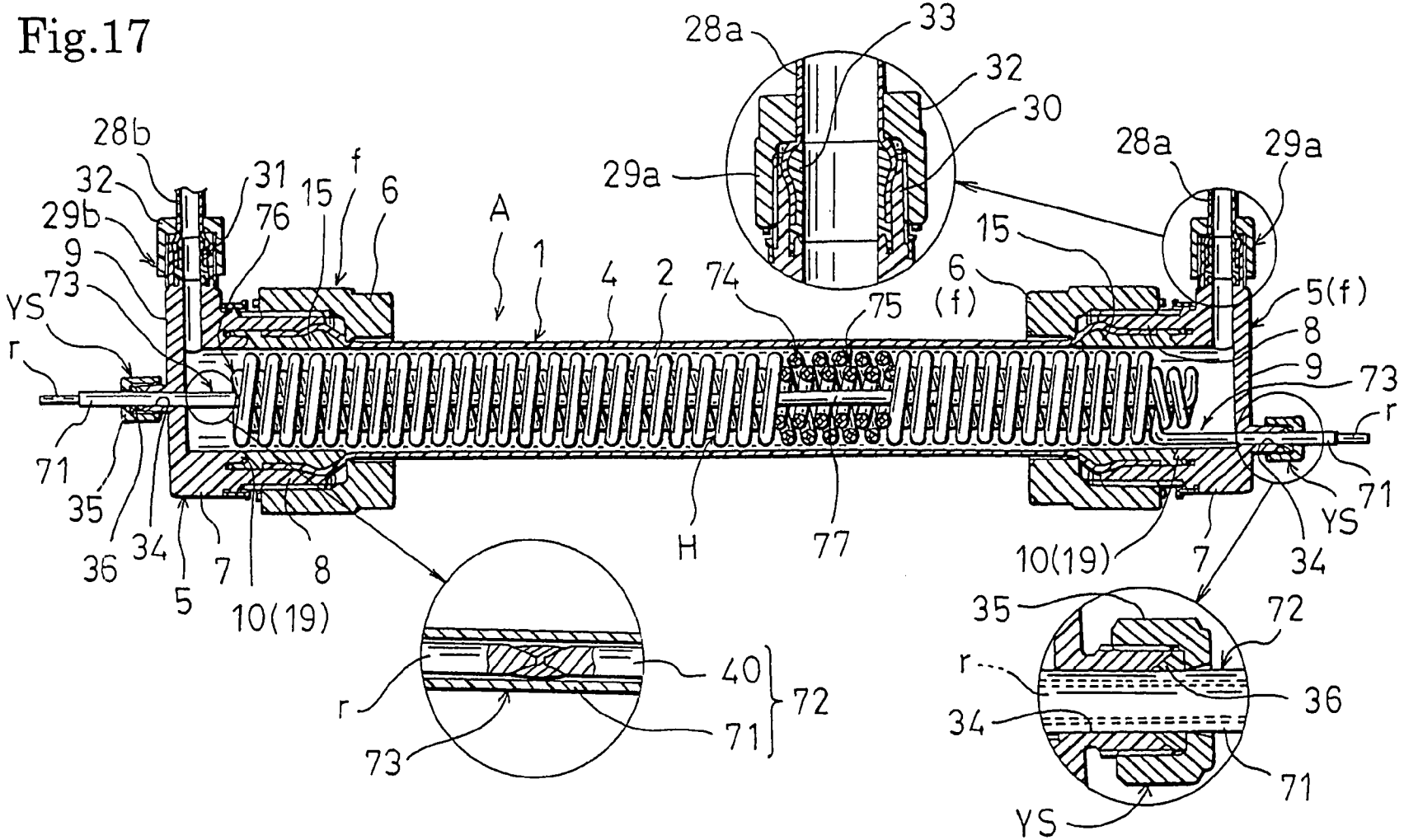
FIG. 17 is a front section view showing a fluid heater of Embodiment 8.

Embodiment 8 is a fluid heater A using a coil heater H in which a heating wire covered by a fluororesin material is double spirally wound, and has a configuration in which a small-diameter spiral heater element is placed inside the spiral heater element shown in FIG. 16. Specifically, as shown in FIG. 17, the coil heater H in Embodiment 8 is configured by forming the heater element 72 in which the heater wire 40 is inserted into the tube 71 of a fluororesin such as PFA, into a double spiral shape having an outer spiral portion 74 and an inner spiral portion 75.

In the side opposite to a fold back portion 76 where the end of the outer spiral portion 74 is continuous to the beginning of the inner spiral portion 75, the heater element 72 in the end portion of the inner spiral portion 75 is folded back to be formed as a linear portion 77 that penetrates the inner center of the inner spiral portion 75 and is passed through the fold back portion 76, and led out to the outside via the heater element connecting portion YS of one of the lid portions f. The beginning side of the outer spiral portion 74 is led out to the outside via the heater element connecting portions YS of the other lid portion f. In Embodiment 8 also, the connecting portions 73 (having the same structure as that shown FIG. 16) for avoiding heat conduction from the heater wire 40 to the lead-out portion 34 are disposed in both end portions of the coil heater H. The employment of the double wound coil heater H can more largely increase the length of the heater wire 40 in the casing 1. Therefore, there are advantages that the heating temperature is made more higher, and that the heating efficiency can be further improved.

Embodiment 9

Embodiment 9 is a fluid heater A using a coil heater H in which a heating wire covered by a fluororesin material is spirally wound, and through which a purge gas is passed. Specifically, as shown FIG. 18, the coil heater H is configured by, in the casing 1, spirally winding a heater element 72 in which a heater wire 40 is inserted into a tube 71 of a fluororesin such as PFA. The heater element is led out to the outside via heater element connecting portions YS of the lid portions f. The heater element 72 is configured by spirally winding the heater wire 40 in the fluororesin tube 71. The configuration identical with the lid portions f is applied to the end portions of the heater element, thereby allowing an exhaust gas for purging to be passed through the fluororesin tube 71.

Figure 18:
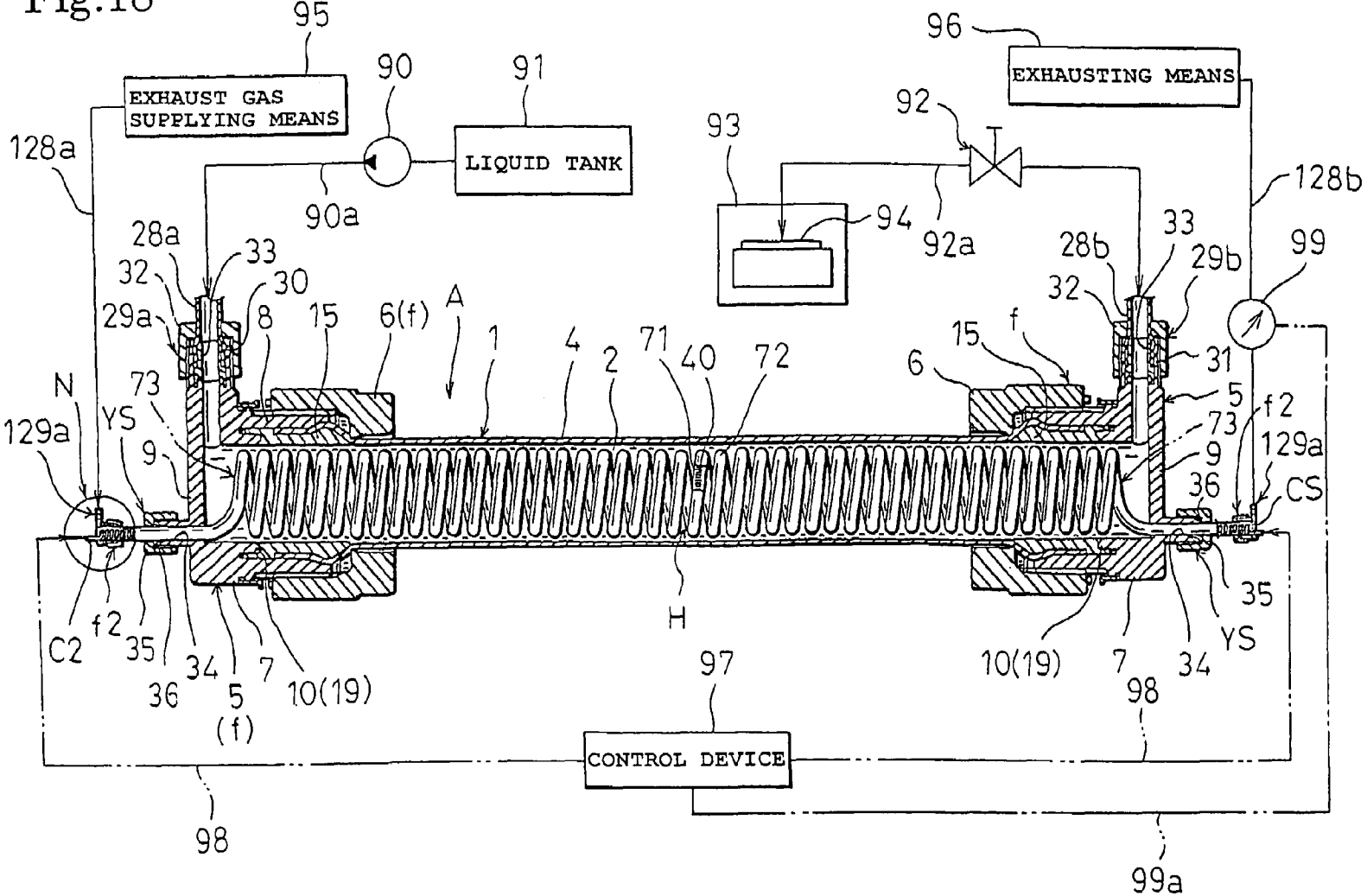
FIG. 18 is a front section view showing a fluid heater of Embodiment 9.
Figure 19:
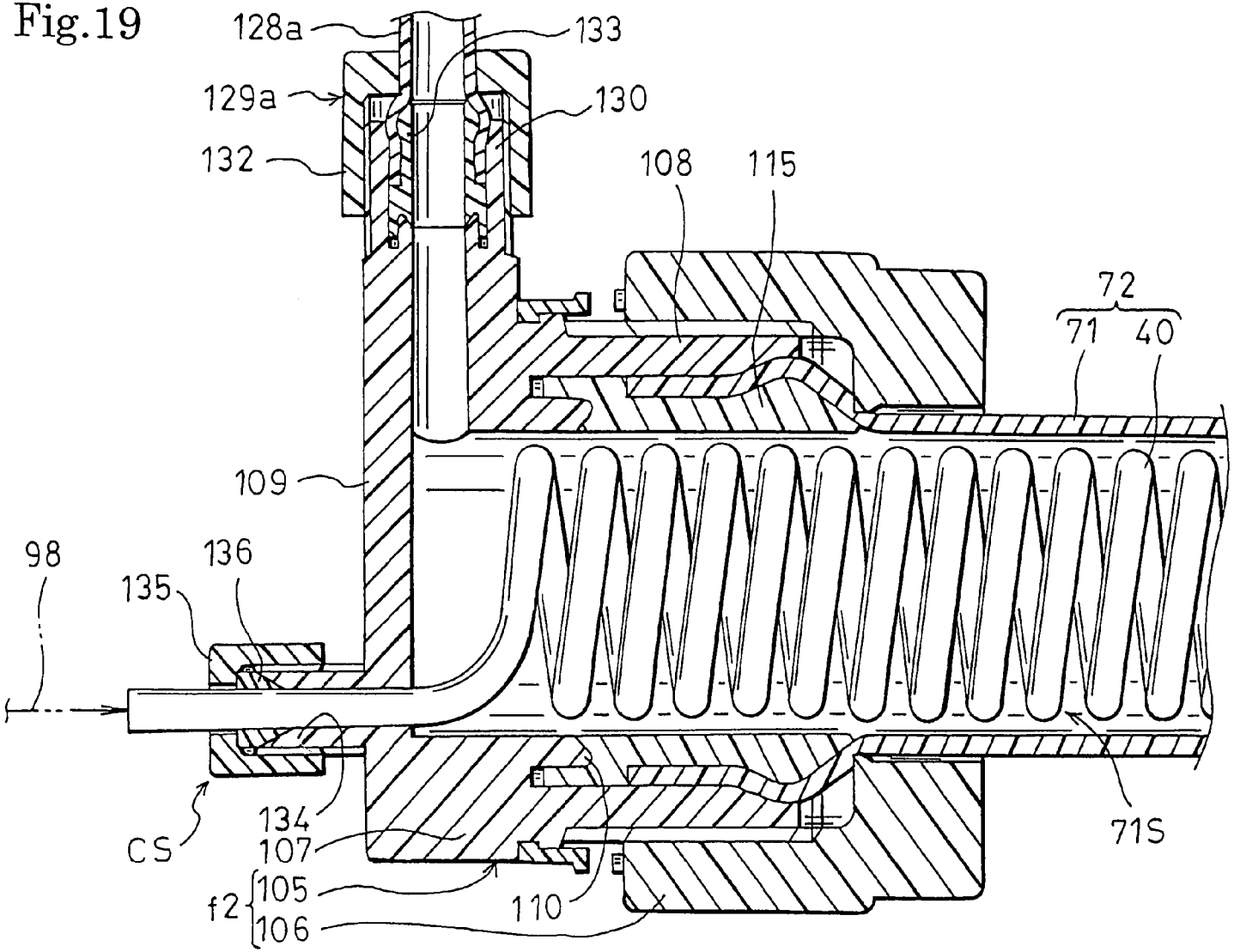
FIG. 19 is an enlarged section view showing the structure of portion N in FIG. 18.

As shown in FIG. 18 and FIG. 19 which is an enlarged view of portion N in FIG. 18, a distinct passage space is formed in the fluororesin tube 71 by the spiral winding of the heater wire 40, and an inert gas such as nitrogen gas is passed through the passage space, thereby forming means for purging the interior of the fluororesin tube 71. An example of the means will be described. The fluid heater A of Embodiment 9 is used as an apparatus for heating a highly permeable chemical liquid in a substrate processing apparatus of an apparatus for producing a semiconductor device. As shown in FIG. 18, a liquid storage tank 91 is connected to the inlet pipe 28*a* via a pump 90 and a supply pipe 90*a*. The heated liquid which is output from the outlet pipe 28*b* is supplied to a to-be-processed substrate 94 in a process chamber 93 via a gate valve 92 and an outlet pipe 92*a*.

Exhaust gas supplying means 95 for purge is connected to one end portion of the fluororesin tube 71 via an inlet connecting portion 129*a* of one second lid portion f2 and a gas supply path 128*a*. Exhausting means 96 is connected to the other end portion via an inlet connecting portion 129*a* of the other second lid portion f2 and a gas discharge path 128*b*. The components of the second lid portions f2 are denoted by reference numerals which are obtained by adding 100 to the reference numerals denoting the corresponding components of the lid portions f shown in FIG. 3, etc. (for example, the lid body 5→105). Basically, the components which are identical in function with those of the lid portions f shown in FIG. 3, etc. are omitted.

The end portions of the heater element 72 are provided with the second lid portions f2 having the configuration which is strictly identical with the lid portions f of the casing 1. The structure of one of the second lid portions f2 will be briefly described with reference to FIG. 19. An end portion of the fluororesin tube 71 is fitted together with an inner ring 115 into a receiving port 108 of the lid body 105, and attached thereto by fastening a union nut 106. The heater wire 40 is led out to the outside via a heater wire connecting portion CS having the same structure as the heater element connecting portions YS. The inner space 71S of the fluororesin tube 71 is connected to the exhaust gas supplying means 95 via the inlet connecting portion 129*a* which is formed in the lid body 105, and which has a fluid supplying/discharging portion 130.

Examples of the highly permeable chemical liquid supplied from the liquid storage tank 91 to the inner space 2 of the casing 1 are aqueous solution of hydrogen fluoride of high concentration (concentration of about 50% or more), and aqueous solution of nitric acid of high concentration (concentration of about 70% or more). Examples of the exhaust gas for purge supplied from the exhaust gas supplying means 95 to the inner space 2 of the casing 1 are an inert gas such as nitrogen gas, and purified air. In the case where the exhaust gas supplying means 95 is formed by a configuration in which the gas supply path 128*a* is connected to a clean room in order to suck purified air, the exhausting means 96 may be configured by an exhaust blower, a ventilation fan, an ejector, or the like, and, in the case where the exhaust gas supplying means 95 involves driven blower means such as an air blower to produce a sufficient exhaust gas pressure, the exhausting means may be configured simply by an exhaust pipe.

Power supply wirings 98, 98 from a control device 97 are connected to the ends of the heater wire 40. Detection information of temperature detecting means 99 such as a thermometer disposed at a position after (preferably, immediately after) the outlet of the second lid portion f2 of the fluororesin tube 71 is supplied to the control device 97 via a signal line 99*a*. According to the configuration, a feedback control for maintaining the temperature of the liquid heated by the coil heater H to a preset value is enabled.

When the fluid heater A is used as a liquid heating apparatus as described above, the following functions and effects can be attained. A highly permeable chemical liquid such as aqueous solution of hydrogen fluoride of high concentration is highly permeable in a liquid state, and exhibits a very high permeability in a gaseous state. Even when the tube 71 covering the heater wire 40 is made of a fluororesin having excellent chemical resistance, consequently, there is the possibility that a highly permeable chemical liquid in a gaseous state permeates the fluororesin tube 71 from the inner side to the outer side. Namely, there arises a problem in that, when a highly permeable chemical liquid which has been once converted to a permeate gas is reliquefied on the surface of the metal heater wire 40, the heater wire 40 is eroded and broken in a short period. As the temperature is higher (for example, 50° C. or more), such a highly permeable chemical liquid exhibits a higher permeability. When a highly permeable chemical liquid is used while heating to a high temperature, therefore, the problem is more prominent.

When the fluid heater A has a configuration involving the accessories shown in FIGS. 18 and 19, however, purified air, an inert gas, or the like is supplied from the exhaust gas supplying means 95 to the inner space 2 of the casing 1 disposed in the state where the coil heater H is placed therein, and scavenging action is caused in the space because of exhaustion by the exhausting means 96. Even when the gas (permeate gas) of the highly permeable chemical liquid passing the outside (inner space 2) of the fluororesin tube 71 permeates the tube to reach the heater wire 40 serving as heating means, therefore, the permeate gas is replaced with the fresh gas introduced from the exhaust gas supplying means 95. Consequently, the permeate gas can be prevented from reliquefying on the surface of the heater wire 40, and the heater wire 40 can be protected from erosion due to the reliquefied highly permeable chemical liquid. As a result, the coil heater H can be prevented from being broken. Therefore, the fluid heater A can be provided as a heater for a highly permeable chemical liquid which has excellent durability against a highly permeable chemical liquid, and in which the life period is prolonged.

As indicated by the phantom lines in FIG. 18, in Embodiment 9 also, the configuration in which the heater wire 40 is terminated in the inner space 2 of the casing 1, and the connecting portions 73 (see the enlarged views in FIGS. 16 and 17) for conductively connecting the heat wire to the lead wires r is disposed is preferable in order to prevent the heater element connecting portions YS, i.e., the lead-out portions 34 from overheating. In this case, although not illustrated, linear lead wires r are disposed in place of the coil-like heater wire 40 in the second lid portions f2, and the lead wires r are led out to the outside via the heater wire connecting portions CS.

Embodiment 10

Figure 20:
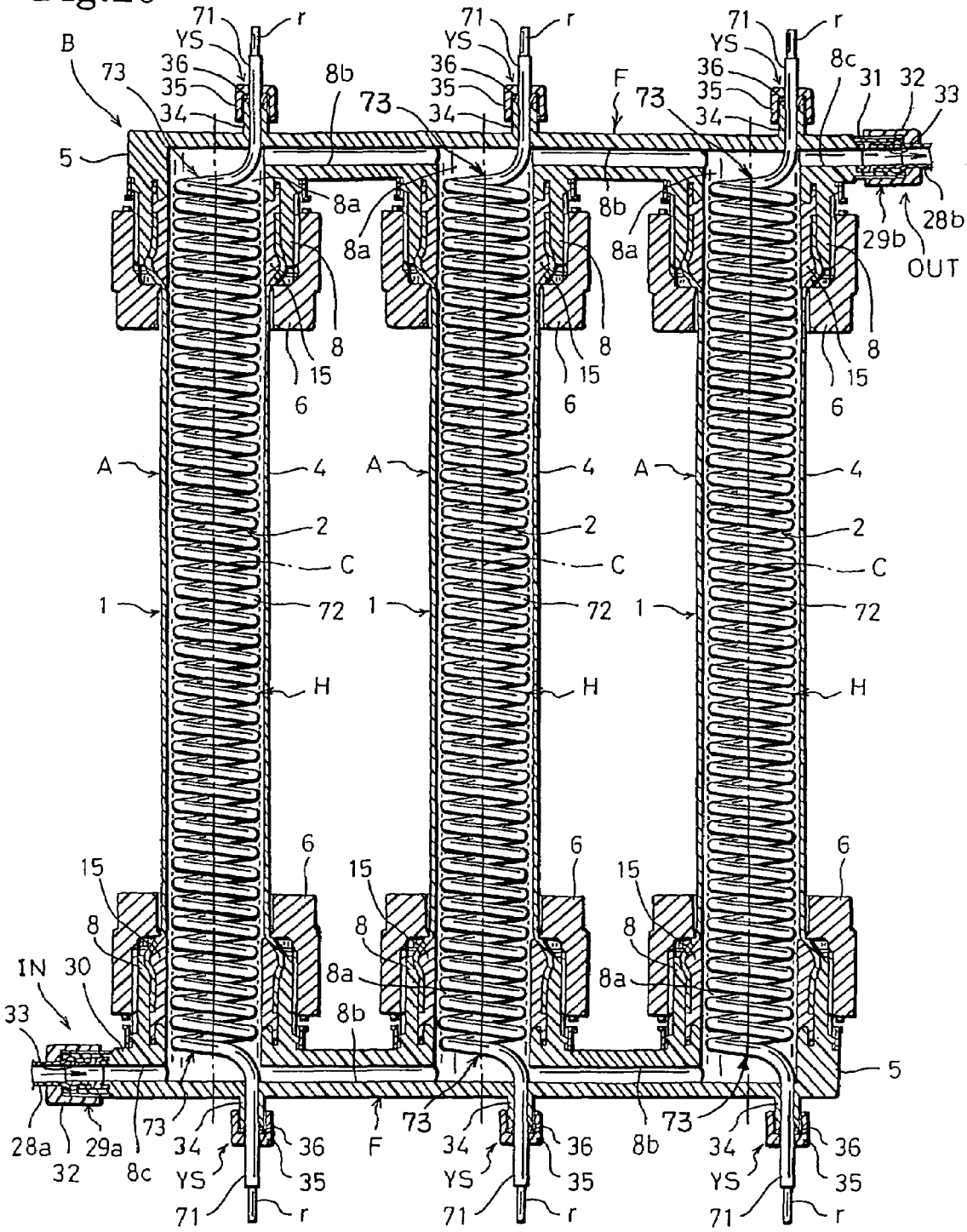
FIG. 20 is a partially fragmentary front view showing a fluid heating apparatus of Embodiment 10.
Figure 21:
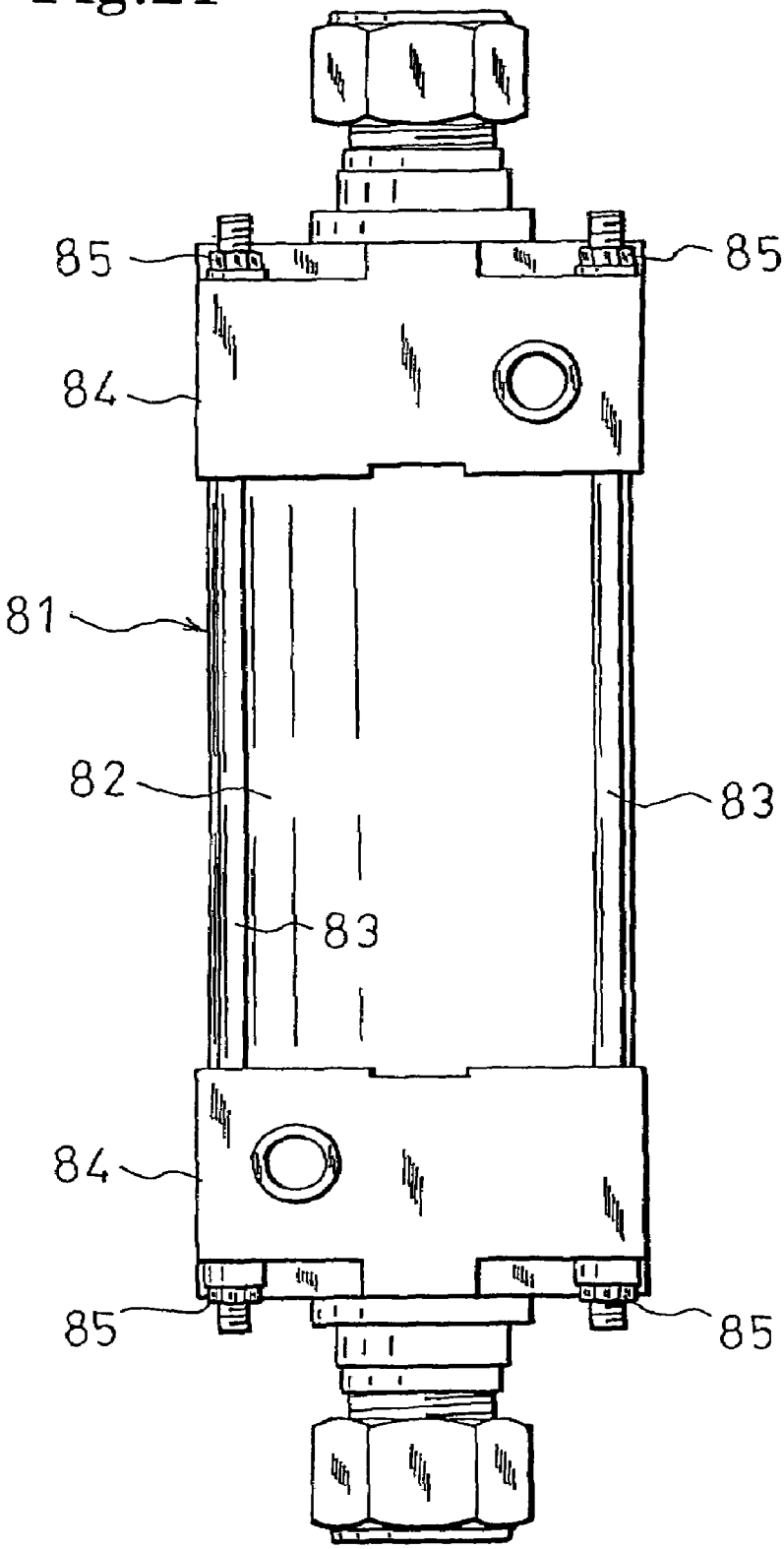
FIG. 21 is a front view showing a conventional fluid heater.
Figure 22:
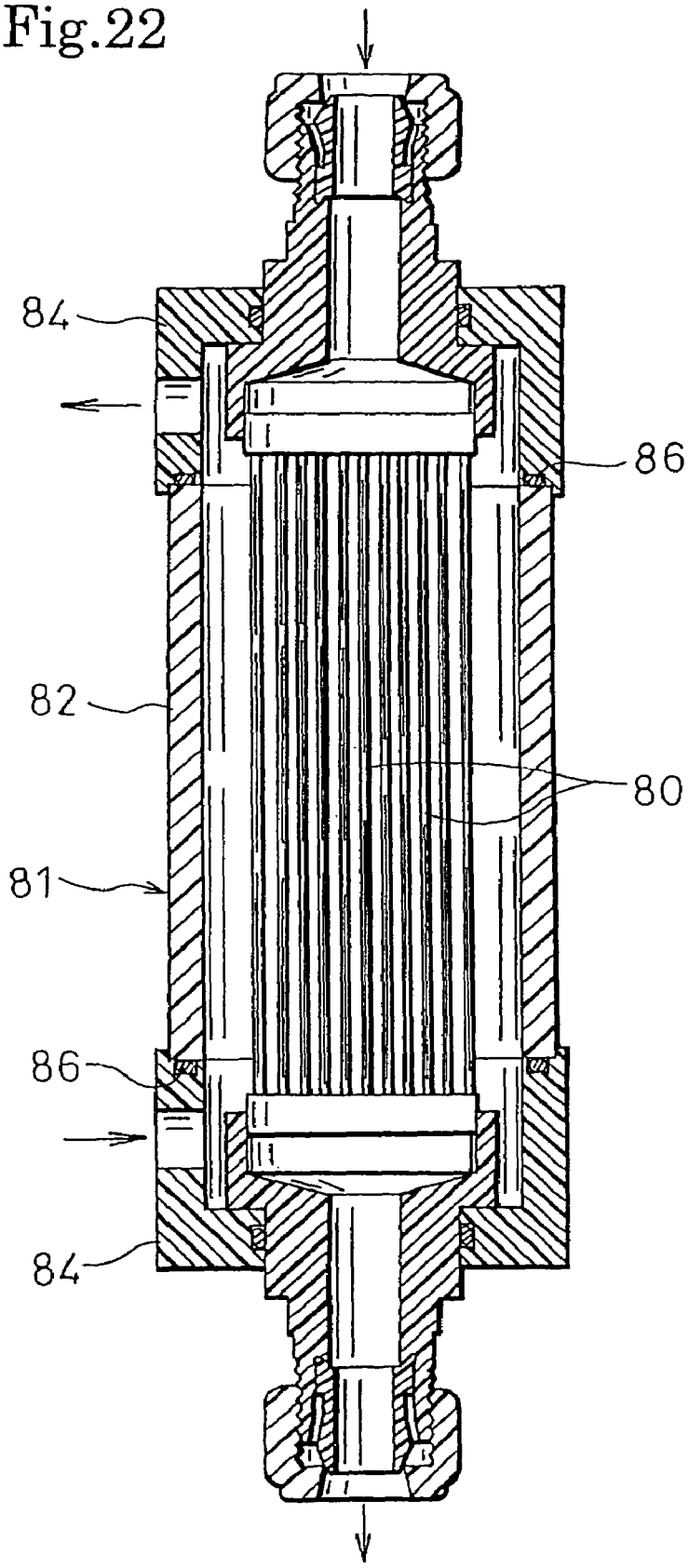
FIG. 22 is a section view of the fluid heater of FIG. 21.

Embodiment 10 is a fluid heating apparatus B which is configured by coupling and integrating three fluid heaters A by one collecting lid portion F (f) on each side. In the fluid heating apparatus B of Embodiment 10, each collecting lid portion F is configured as one single component in which, as shown in FIG. 20, three tubular receiving ports 8 upstand from the lid body 5 having a laterally elongated shape, and two coupling paths 8*b* in total which communicatingly connect together inner-lid spaces 8*a* formed in the respective receiving ports 8, and one supplying/discharging path 8*c* for forming fluid supplying/discharging portions 30, 31 are formed.

In each collecting lid portion F, three receiving ports 8 are formed in the lid portion f shown in FIG. 3, etc. in order to enable a plurality of case bodies 4 to be detachably attached, and naturally the lead-out portions 34 also are formed in three places. Namely, the collecting lid portion is a combination of three lid portions f and two intermediate pipes 60 which are shown in FIG. 12, etc. In this case, in the coil heater H, the heater element 72 is used in which the heater wire 40 connected at both ends to the lead wires r is covered by the fluororesin tube 71. In the fluid heating apparatus B shown in FIG. 20, the components identical with those of the fluid heater A shown in FIG. 16 are denoted by the same reference numerals.

When the collecting lid portions F are used, there is advantage that the effects equivalent to those of the fluid heating apparatus shown in FIG. 12 can be attained while the reduction of the number of components and the cost reduction due to it are enabled as compared to the fluid heating apparatus shown in FIG. 12. The three-in-one fluid heating apparatus shown in FIG. 20 is configured as a parallel type in which three casings 1 are connected to each other in parallel by using the fluid supplying/discharging portions 30, 31 disposed in the collecting lid portions F. Although not illustrated, the coupling paths 8*b* can be adequately cut off, so that a series fluid heating apparatus B in which the three casings 1 are connected in series is formed. Next, several examples of a fluid heating apparatus B in which many fluid heaters A are connected together will be described as "Other embodiments".

Other Embodiments

Figure 13A:
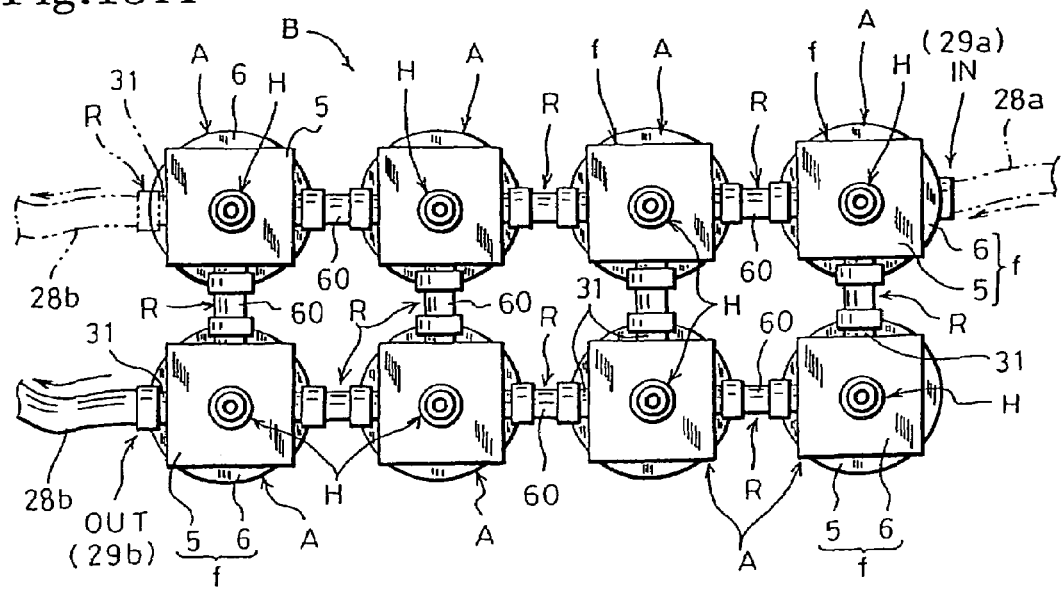
FIGS. 13A and 13B are plan views showing other structures of the fluid heating apparatus, respectively.

As shown in FIG. 13A, plural fluid heaters A are coupled in parallel laterally and back and forth. As an example, FIG. 13A shows a plan view of a fluid heating apparatus B in which four rows in the lateral direction and two rows in back and forth or eight fluid heaters A in total are coupled to one another in parallel. In this case, as lid bodies 5 of the lid portions f, lid bodies in which two fluid supplying/discharging portions 31 (or 30) are formed, and those in which three fluid supplying/discharging portions are formed are required. The inlet IN is disposed in the lower lid body 5 of the fluid heater A which is positioned in the right end and the front side, and the inlet pipe 28*a* is connected to the inlet. The outlet OUT is disposed in the upper lid body. 5 of the fluid heater A which is positioned in the left end and the rear side, and the outlet pipe 28*b* is connected to the outlet.

As indicated by the phantom lines in FIG. 13A, the outlet OUT may be disposed also in the lid body 5 of the upper lid portion f of the fluid heater A which is positioned in the left end and the front side, and the outlet pipe 28*b* may be connected to the outlet. Although not illustrated, a configuration in which two inlet pipes 28*a* are disposed is enabled. Since many connecting portions R exist, for example, the central two sets of the four sets of connecting portions R which are arranged laterally and back and forth may be omitted. Namely, it is sufficient to configure a structure in which a fluid is distributed to all the lid bodies 5, and it is not always necessary to connect all portions between adjacent lid bodies 5.

Figure 13B:
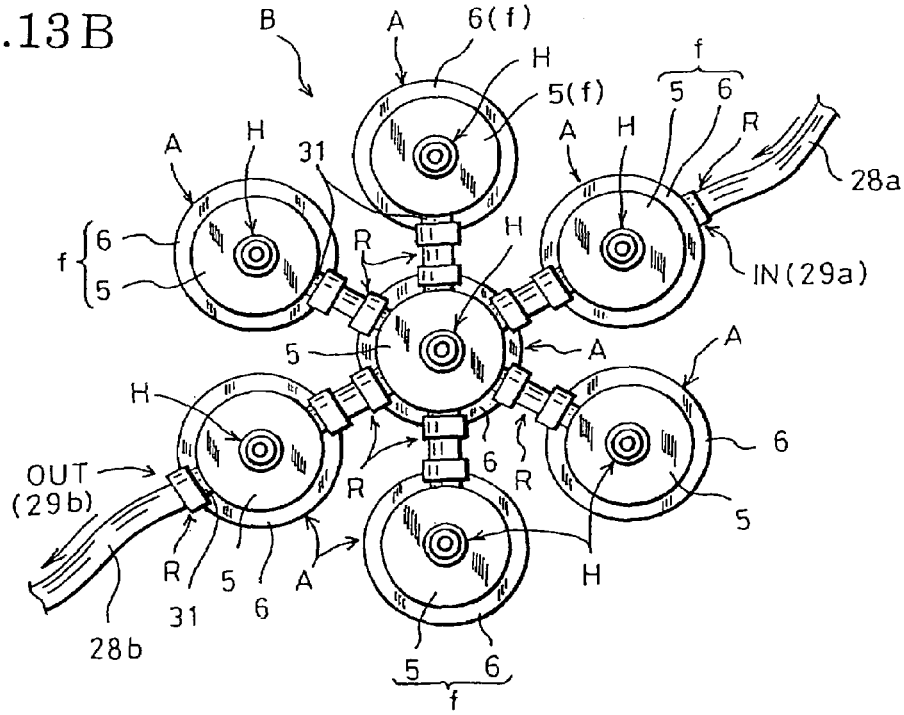

As shown in FIG. 13B, a fluid heating apparatus B in which six fluid heaters A are arranged around one fluid heater, or the fluid heaters are arranged in a star-like shape is enabled. A fluid heating apparatus B of such a shape is effective in the case where a cylindrical space is available as an installation space. Each of the fluid heaters A has circular lid bodies 5. Only the center fluid heater A has lid bodies 5 of upper and lower lid portions f in each of which six fluid supplying/discharging portions 31 (or 30) are formed. In the other fluid heaters A except two fluid heaters A in which the inlet IN and the outlet OUT are respectively disposed, one fluid supplying/discharging portion 31 (or 30) is formed in each of the lid bodies 5.

A fluid heating apparatus B in which two or more fluid heaters A are connected in parallel is not restricted to the above-described configurations, and may have various kinds of combinations. For example, a fluid heating apparatus B may be enabled in which heater groups each consisting of 25 fluid heaters A that are arranged in five by five laterally and longitudinally (back and forth, and right and left) are vertically connected to each other in series, or which is configured by 50 fluid heaters A in total. In the case where the flow amount per unit time is large, a fluid heating apparatus B in which a plurality of fluid heaters A are connected in parallel is convenient, and, in the case where the flow amount per unit time is small but a heating temperature is high, a fluid heating apparatus B in which a plurality of fluid heaters A are connected in series is convenient. In this way, the fluid heating apparatus B can be configured by any specification in accordance with a combination of the fluid heaters A, for example, a flat shape or a stereoscopic shape, or a configuration in which a high temperature rise is enabled. The invention has an excellent feature that a fluid heating apparatus having any configuration can be constructed in accordance with the user's wish.

The fluid heater A and the fluid heating apparatus B which have been described above may be used in such a manner that, for example, gate valves are disposed in the inlet IN and the outlet OUT, a fluid introduced into the casing 1 is heated by the rod-like heater H in a state where the fluid is once stored in the interior 2 of the casing 1, to be heated to a sufficiently high or predetermined temperature, and then the heated fluid is discharged from the outlet OUT. Furthermore, temperature detecting means for measuring the temperature in the casing 1, such as a sensor, an opening and closing mechanism for driving the gate valves, a controlling device, and the like can be disposed, thereby constructing "automatic fluid heating controlling apparatus" in which a fluid that is introduced in various temperature ranges is automatically controlled so as to be heated to a preset temperature, and then discharged to the outside of the casing 1.

For example, the fluid heater or fluid heating apparatus of the invention can be used as an ultrapure-water heating apparatus configured so that ultrapure water at a pressure higher than the atmospheric pressure is introduced from the inlet into the casing, the ultrapure water is heated by the rod-like heater disposed in a lower portion of or upper and lower portions of the interior of the casing, and the ultrapure water which is stored in the upper portion of the interior of the casing after heated to a constant temperature is discharged from the outlet in the upper portion of the casing. According to the configuration, after the ultrapure water stored in the apparatus is heated to the constant temperature, the ultrapure water of a high temperature can be supplied by the pressure (higher than the atmospheric pressure) of the ultrapure water. Therefore, facilities for supplying ultrapure water, such as an additional storage tank and laying of pipes for introducing an inert gas are not required, and the effect that the facility cost and the running cost can be reduced is attained.

What is claimed is:

1. A fluid heater having: a casing configured by a case body formed by a tube member, and lid portions which are detachably attached to respective end portions of said case body to close the end portions; a heater which is passed through at least one of said lid portions to be placed in an interior of said case body; and fluid supplying/discharging portions for an inner space of said case body which are formed in at least two places of said lid portions, respectively; and wherein said tube member is made of a flexible synthetic resin, each of said lid portions is configured by: a lid body having a receiving port which receives a corresponding one of the end portions of said case body, and at least one sealing face which is disposed in said receiving port; a union nut which is externally screwable with a receiving port-side end portion of said lid body in a state where said union nut is externally fitted to the end portion of said case body; and at least one sealing portion which is formed by screwingly advancing said union nut to said lid body to press said case body from an outside, and by closely contacting the end portion of said case body with said sealing face of said lid body by the pressing function, a lead-out portion through which said heater is passed is formed in said lid body of at least one of said lid portions, and said fluid supplying/discharging portions are formed in said lid bodies as portions through which a fluid passing a flow path portion is introduced or discharged, said flow path portion being outside said heater in said casing; and each of said sealing portions is formed by close contact between: a sealing face configured by forming a tapered face in a position inner than an inlet of said receiving port, said tapered face having a diameter which is gradually increased toward an outer side in an axial direction of said lid body; and a projection end face formed by a tapered face which is formed in a tip end of a projection portion of an inner ring, said projection portion being projected from the end portion of said case body, said inner ring being pressingly inserted into the end portion of said case body to increase a diameter of the end portion into a mountain-like section shape.

2. A fluid heater according to claim 1, wherein a heating portion of said heater is placed only in an interior of said casing which forms said flow path portion.

3. A fluid heater according to claim 2, wherein each of said sealing portions is Conned by close contact between: a sealing face configured by forming a tapered face in a position inner than an inlet of said receiving port, said tapered face having a diameter which is gradually increased toward an outer side in an axial direction of said lid body; and a projection end face formed by a tapered face which is formed in a tip end of a projection portion of an inner ring, said projection portion being projected from the end portion of said case body, said inner ring being pressingly inserted into the end portion of said case body to increase a diameter of the end portion into a mountain-like section shape.

4. A fluid heater according to claim 1, wherein each of said sealing portions is formed by pressingly holding the end portion of said case body in an inclined state between: a sealing face which is formed in an inlet of said receiving portion of said lid body by a tapered face intersecting with an axis of said lid body; and an inward tapered face which is formed on an inclined face of a press-insertion portion of an inner ring which is pressingly inserted into the end portion of said case body to increase a diameter of the end portion into a mountain-like section shape.

5. A fluid heater according to claim 2, wherein each of said sealing portions is formed by pressingly holding the end portion of said case body in an inclined state between: a sealing face which is fanned in an inlet of said receiving portion of said lid body by a tapered face intersecting with an axis of said lid body; and an inward tapered face which is formed on an inclined face of a press-insertion portion of an inner ring which is pressingly inserted into the end portion of said case body to increase a diameter of the end portion into a mountain-like section shape.

6. A fluid heater according to claim 1, wherein each of said sealing portions is formed by pressingly holding the end portion of said case body in an inclined state between: a sealing face which is formed in an inlet of said receiving portion of said lid body by a tapered face intersecting with an axis of said lid body; and an inward tapered face which is formed on an inclined face of a press-insertion portion of an inner ring which is pressingly inserted into the end portion of said case body to increase a diameter of the end portion into a-mountain-like section shape.

7. A fluid heater according to claim 3, wherein each of said sealing portions is formed by pressingly holding the end portion of said case body in an inclined state between: a sealing face which is formed in an inlet of said receiving portion of said lid body by a tapered face intersecting with an axis of said lid body; and an inward tapered face which is formed on an inclined face of a press-insertion portion of an inner ring which is pressingly inserted into the end portion of said case body to increase a diameter of the end portion into a mountain-like section shape.

8. A fluid heater according to claim 1, wherein each of said sealing portions is formed by making a cylindrical portion fittable into an annular groove, said cylindrical portion being formed in a tip end of a projection portion or said inner ring pressingly inserted into the end portion of said case body, said annular groove being formed in an radially outer side with respect to said sealing face that is formed in an inner portion of said receiving portion of said lid body, and elongating parallel to an axis of said lid body.

9. A fluid heater according to claim 3, wherein each of said sealing portions is formed by making a cylindrical portion fittable into an annular groove, said cylindrical portion being formed in a tip end of a projection portion of said inner ring pressingly inserted into the end portion of said case body, said annular groove being formed in an radially outer side with respect to said sealing face that is formed in an inner portion of said receiving portion of said lid body, and elongating parallel to an axis of said lid body.

10. A fluid heater according to claim 4, wherein each of said sealing portions is formed by making a cylindrical portion fittable into an annular groove, said cylindrical portion being formed in a tip end of a projection portion of said inner ring pressingly inserted into the end portion of said case body, said annular groove being formed in an radially outer side with respect to said sealing race that is formed in an inner portion of said receiving portion of said lid body, and elongating parallel to an axis of said lid body.

11. A fluid heater according to claim 5, wherein each of said sealing portions is formed by making a cylindrical portion fittable into art annular groove, said cylindrical portion being formed in a tip end of a projection portion of said inner ring pressingly inserted into the end portion of said case body, said annular groove being formed in an radially outer side with respect to said sealing face that is formed in an inner portion of said receiving portion of said lid body, and elongating parallel to an axis of said lid body.

12. A fluid heater according to claim 6, wherein each of said sealing portions is formed by making a cylindrical portion fittable into an annular groove, said cylindrical portion being formed in a tip end of a projection portion of said inner ring pressingly inserted into the end portion of said case body, said annular groove being formed in an radially outer side with respect to said sealing face tat is formed in an inner portion of said receiving portion of said lid body, and elongating parallel to an axis of said lid body.

13. A fluid heater according to claim 7, wherein each of said sealing portions is formed by making a cylindrical portion fittable into an annular groove, said cylindrical portion being formed in a tip end of a projection portion of said inner ring pressingly inserted into the end portion of said case body, said annular groove being formed in an radially outer side with respect to said sealing face that is formed in an inner portion of said receiving portion of said lid body, and elongating parallel to an axis of said lid body.

14. A fluid heater according to claim 1, wherein said lid portion attached to one of the end portions of said case body is identical with said lid portion attached to the other end portion.

15. A fluid heater according to claim 1, wherein said case body and said lid portions are made of a fluororesin.

16. A fluid heater according to claim 1, wherein said heater is a cartridge heater which is covered by a fluororesin material.

17. A fluid heater according to claim 1, wherein said heater is a lamp heater which is covered by a fluororesin material.

18. A fluid heater according to claim 1, wherein said heater is a coil heater in which a heating wire covered by a fluororesin material is spirally wound.

19. A fluid heating apparatus wherein a plurality of fluid heaters according to claim 1 are combined with one another, and said fluid supplying/discharging portions of said fluid heaters are communcatingly connected to each other to, in each of said fluid heaters, allow a fluid to pass through an interior of said casing.

20. A fluid heating apparatus according to claim 19 wherein said lid portions are configured to enable a plurality of said case bodies to be detachably attached to said lid portions, whereby said fluid heaters are combined to each other to, in each of said fluid heaters, allow a fluid to pass through the interior of said casing.

* * * * *